US010118751B2

(12) United States Patent
Couvillon et al.

(10) Patent No.: US 10,118,751 B2
(45) Date of Patent: Nov. 6, 2018

(54) OVERSIZE BEVERAGE CARRIER BOX

(71) Applicant: Southern Champion Tray, L.P., Chattanooga, TN (US)

(72) Inventors: Ron Couvillon, Whitwell, TN (US); Candace Carlton, Hixson, TN (US); Stokes Smith, Signal Mountain, TN (US); Anne Hooser, Chattanooga, TN (US); Sarah Williams, Morton Grove, IL (US); Matt Raus, Phoenix, AZ (US); Jason Ray, Westfield, IN (US)

(73) Assignee: Southern Champion Tray, L.P., Chattanooga, TN (US)

( * ) Notice: Subject to any disclaimer, the term of this patent is extended or adjusted under 35 U.S.C. 154(b) by 33 days.

(21) Appl. No.: 15/338,431

(22) Filed: Oct. 30, 2016

(65) Prior Publication Data

US 2017/0210533 A1 Jul. 27, 2017

Related U.S. Application Data

(60) Provisional application No. 62/249,063, filed on Oct. 30, 2015.

(51) Int. Cl.

| | |
|---|---|
| ***B65D 77/06*** | (2006.01) |
| ***B65D 5/50*** | (2006.01) |
| ***B65D 5/46*** | (2006.01) |
| ***B65D 5/00*** | (2006.01) |
| ***B65D 5/42*** | (2006.01) |

(52) U.S. Cl.

CPC ..... *B65D 77/065* (2013.01); *B65D 5/008* (2013.01); *B65D 5/4266* (2013.01); *B65D 5/46072* (2013.01); *B65D 5/5035* (2013.01)

(58) Field of Classification Search

CPC .... B65D 77/065; B65D 5/008; B65D 5/4266; B65D 5/46072; B65D 5/5035; B65D 5/72; B67D 3/0067

USPC ..... 229/113, 108, 117.12, 142; 222/565

See application file for complete search history.

(56) References Cited

U.S. PATENT DOCUMENTS

| | | | |
|---|---|---|---|
| 1,342,770 | A * | 6/1920 | Selz |
| 1,811,074 | A * | 3/1929 | Butler |
| 2,135,855 | A * | 11/1938 | Snyder |
| 9,415,997 | B2 * | 8/2016 | Coogan et al. |

* cited by examiner

*Primary Examiner* — Christopher Demeree

(74) *Attorney, Agent, or Firm* — Miller & Martin PLLC; Douglas T. Johnson

(57) ABSTRACT

A corrugated board carrier for an interior bulk beverage container is provided with a larger base, integral handles, and a ramp insert to promote gravity dispensing of beverages therein through a spout.

12 Claims, 53 Drawing Sheets

OVERSIZE BEVERAGE CARRIER BOX

FIELD OF THE INVENTION

This invention relates to an improved beverage container. More specifically, this invention is directed to an improved oversized fillable container for storing, transporting, and dispensing beverages.

BACKGROUND OF THE INVENTION

In the development of beverage packaging, numerous attempts have been made to provide paperboard packaging for fluids, utilizing a plastic bag within the paperboard structure to hold the fluid. As these packages evolved to have dispensing spouts secured and extending from the paperboard packaging, many product features have been refined, including the secure mounting of spouts and the design of spouts that were easy to use. It has also been desirable to make the inner pouches of these containers removable so that plastic and cardboard or paperboard material can be recycled separately after use. As the bag in box packaging has evolved, some packaging has been designed for the particular use of conveying hot or cold liquids and maintaining an appropriate serving temperature. For instance, a coffee shop or restaurant might utilize a paperboard and plastic bag in box style carton in lieu of a returnable thermos to allow customers to carry multiple servings of branded coffee for use at meetings at location remote from the retail shop dispensing the beverage. Similarly, a restaurant may provide soup in a paperboard and plastic bag in box container.

Most of these containers have provided a paperboard outer shell with an opening for a spout on a front vertical panel or forward directed angled panel. When the opening is on the front vertical panel, in order to fill the bag, the container is rested on its back. In these designs, a handle, if any, protrudes from the top of the paperboard box. The existing bag in box packaging designs provide many options for consumer use and carrying of beverages in amounts ranging from about 96 ounces to 160 ounces.

However, on occasion, it is desirable to carry larger quantities of beverages. One industry that frequently uses containers to transport food and beverages is the catering industry. Often food and beverages are transported from a preparation site or a storage area to a catered event. The food containers are often disposable and therefore may be thrown away after the event and do not have to be returned to the caterer or picked up by the caterer after the event. Caterers also would prefer to have disposable beverage containers available so that beverage containers would not need to be returned to or retrieved by the caterer. For effective use in catering application, containers need to be larger than the 96-160 ounce range, as containers of that size necessitate an unreasonable multiplicity of smaller containers that create logistics issues in moving from place to place. In addition, due to their size many small containers present greater surface area to the ambient atmosphere and will inherently fail to maintain beverages at a desired hot or cold temperature for the same length of time that a larger container might. There is also a greater amount of material and waste used in creating many smaller containers than several large containers, However, as containers become larger, it is necessary that containers be constructed in a fashion that provides adequate strength for their use over several hours' time. A beverage container would not be acceptable if it tended to buckle over time or if it could be easily tipped over, or if it was not constructed to be easily handled in transportation and in filling and dispensing beverages.

One attempt at providing such an oversize beverage container is described in U.S. Pat. No. 6,736,289. However, this container has a complicated base structure that may not be readily assembled by catering employees, and lacks a reinforced handle structure that is needed when carrying beverage weights that can be in excess of 20 pounds.

In addition to the weight issue making strong handle structure desirable, an oversize beverage carrier box is not easily tipped to dispense beverages by pouring. As a result, such a container requires an elevated tap to dispense beverages. When the tap is elevated, it means that if the container inside of the box extends below the tap location, a low resting pool of beverage will result that is not dispensable by gravity flow. It is also desirable that the beverage carrier be compact and it is preferable that the container can be shipped flat and expanded into an assembled box when needed by the user.

All of these requirements must be addressed in a stable and robust structure. Accordingly, it is desirable to provide a new oversize beverage carrier box structure to address one or more of these shortcomings and to provide additional benefits to businesses transporting substantial quantities of beverages to consumers.

SUMMARY OF THE INVENTION

Accordingly, an improved oversize box for beverage transport is provided that can be shipped as a folded and glued paperboard blank and assembled with a plastic bag and insert at the location where beverages are prepared for transport to a second location. The design provides a robust and un-tippable structure with elevated tap, reinforced handles, and nearly complete gravity dispensing of the beverage contained within the box.

The design provides for exterior handles so users do not have to grasp through the exterior walls enclosing the bag of beverage to where they might contact an uncomfortably hot liquid. Structures are provided to securely hold the tap and fill spout of the enclosed plastic bag.

For the purpose of summarizing the invention and the advantages achieved over the prior art, certain objects and advantages of the invention have been described above. It is not necessary that all objects or advantages be achieved in accordance with any particular embodiment of the invention. Thus for example, those skilled in the art will recognize that the invention may be embodied or carried out in a manner that achieves or optimizes one advantage as taught herein without necessarily achieving other objects or advantages as may be taught or suggested herein.

BRIEF DESCRIPTION OF THE DRAWINGS

Turning then to the drawings, several embodiments of one or more aspects of the invention will be discussed in detail. The drawings depict exemplarily blanks and beverage containers for illustrative purposes only and include the following figures with like numerals indicating like parts.

DETAILED DESCRIPTION OF THE DRAWINGS

Corrugated board is commonly used in the construction of beverage carrier boxes for several reasons, the relative economic cost of corrugated stock and its ready recyclability principle among them. Corrugated stock has several interesting qualities that can be utilized to its advantage. First, since corrugated board stock contains channels of air between layers of craft container board, the material provides good insulating qualities relative to its cost and weight. In addition, corrugated cardboard provides relatively weak compressive and tensile resistance to forces applied laterally so that it may be easily folded along lines into desired three dimensional shapes. Often the corrugated stock will be scored along desired folding lines to facilitate fabrication of a three-dimensional product. Finally, when forces are applied to corrugated stock in longitudinal directions, the corrugated stock is substantially more resistive to deformation. If compressive force is applied in a direct longitudinal fashion, significant resistance is offered. If tensile force is applied in a direct longitudinal fashion, the multi-layer structure is very resistant to separation and failure. It will be to the advantage of the embodiments illustrated below to utilize these features of corrugated stock in the construction of a beverage container box, although fabrication with alternative materials is also feasible.

Figure 1A:
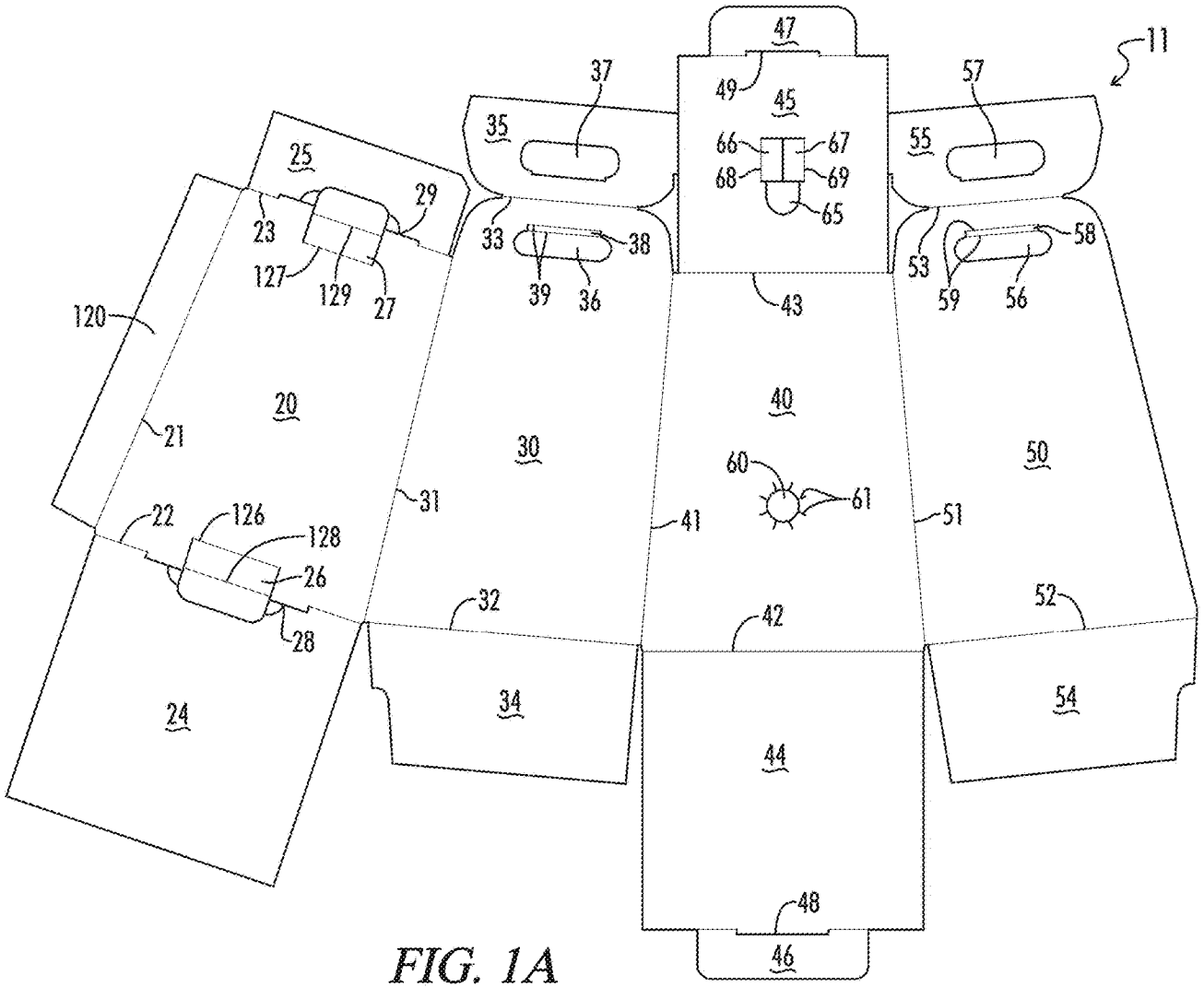
FIG. 1A is a top schematic plan view of a blank from which an outer shell of an oversize beverage carrier box can be constructed.

Turning then to FIG. 1, a schematic or die cut illustration of the outer shell 11 of an embodiment of the invention is provided with rear, left, front, and right shell panels, 20,30,40,50. To the left of shell panels are fold lines 21,31,41,51 respectively and to the left of fold line 21 of the rear shell panel is attachment tab 120 designed for application of adhesive to its upper surface and attachment to the bottom surface of right shell panel 50.

Each of shell panels 20,30,40,50 has a bottom fold 22,32,42,52 and a top fold 23,33,43,53, a bottom panel 24,34,44,54 and a top panel 25,35,45,55. Left and right shell panels 30,50 each have a handle tab 36,56 and on their attached top panels 35,45 are handle panels with handle openings 37,57. As the outer shell is constructed into the beverage container box, top handle panels 35,55 are folded down along top fold lines 33,53 onto the upper rear portions of left and right shell panels 30,50 and handle tabs 36,56 are pushed through handle openings 37,57. The handle tabs 38,58 have double folds 39, 59 that enable handle tab necks 38,58 to extend across the width of top handle panels 35,55 and provide a good gripping point for carrying the fully assembled beverage carrier box.

Rear shell panel 20 has a bottom tab 26 and a top tab 27 that are used in securing the top and bottom closures of the completed beverage carrier box. Rear bottom tab 26 has fold lines 126 and 128 and adjacent to rear bottom fold 23 is rear bottom slit 28 which is adapted to receive front bottom panel tab 46. Similarly, rear top tab 27 has fold lines 127,129 and rear top fold 23 is spaced about rear top slit 29 which is adapted to receive front top panel tab 47.

Front shell panel 40 has tabs and slits on its front top panel 45 and front bottom panel 44 adapted to latch with the structures on rear shell panel 20. Specifically, on front bottom panel 44, front bottom tab 46 is downwardly foldable and contains front bottom tab slit 48 that is adapted to receive the end of rear bottom tab 26. On front top panel 45, front top panel tab 47 is foldable and has front top slit 49 which is adapted to receive rear top tab 27. Front top panel 45 also contains an arched opening 65 and foldable panels 66,67 defined by fold lines 68,69 that open to permit passage of fill cap 14 (shown in FIG. 3A). Front shell panel 40 also contains opening 60 surrounded by radial cuts 61 that allow adjacent panel segments to flex and allow entry of tap 16 (shown in FIG. 3A).

Tap 16 should generally have a neck that allows the dispensing portion 85 of the tap to extend about one inch or more forward of a front shell panel 40 to permit a beverage cup to be easily filled beneath it. Opening 60 is preferably about four to seven inches above the front bottom fold 42 so that the tap 16 is spaced sufficiently above the resting surface upon which the beverage carrier box 10 is set that a cup may be placed or tilted beneath the tap dispenser 85 to be filled. At greater heights, there becomes larger wasted area within the carrier box 10 since the bag 13 holding beverages within the box must be largely positioned above the tap location 60 so that beverages will be readily dispensed by gravitational force.

Figure 1B:
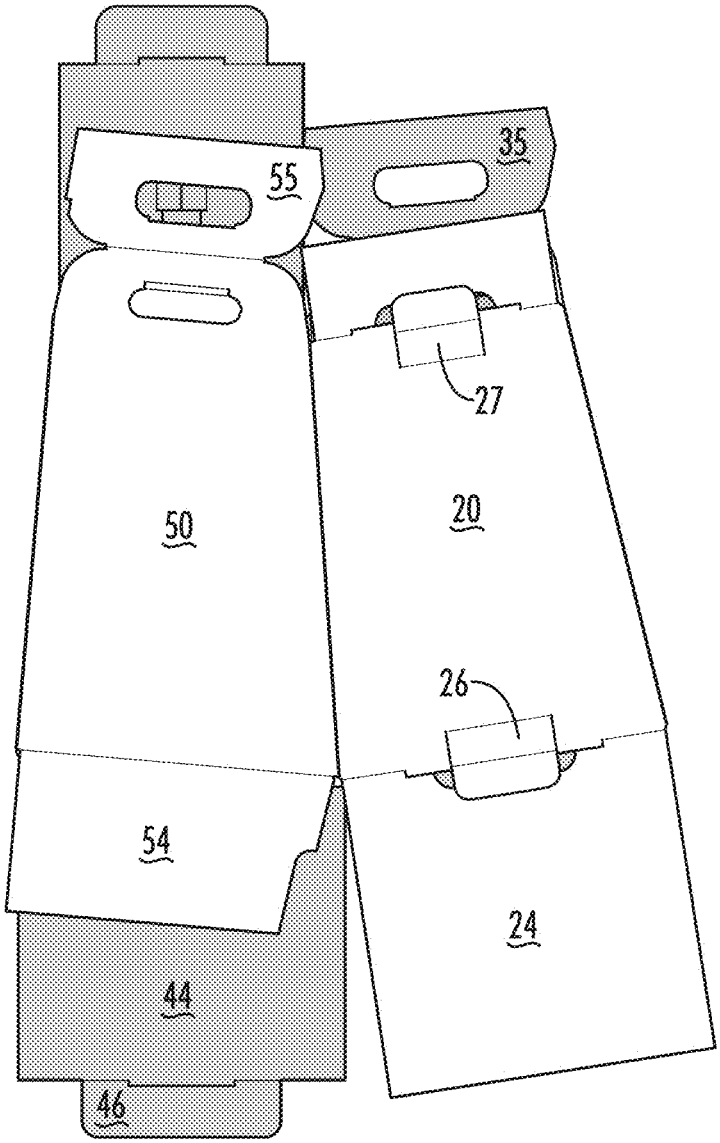
FIG. 1B is a top plan view of a folded and glued outer shell as depicted in FIG. 1A.

After tab 120 is fastened to the rear of right shell panel 50, the resulting construction may be flattened as shown in FIG. 1B. The flattened orientation is preferred for shipment and storage. It can be seen in FIGS. 1A and 1B that the upper fold lines 23,33,43,53 are shorter than the lower fold lines 22,32,42,52 because the shell panels 20,30,40,50 are tapered from bottom to top. This tapered allows the completed beverage carrier box to have a slightly pyramidal shape for enhanced stability. As discussed below, the pyramidal shape also enhances the load bearing capability of the box 10.

Figure 2A:
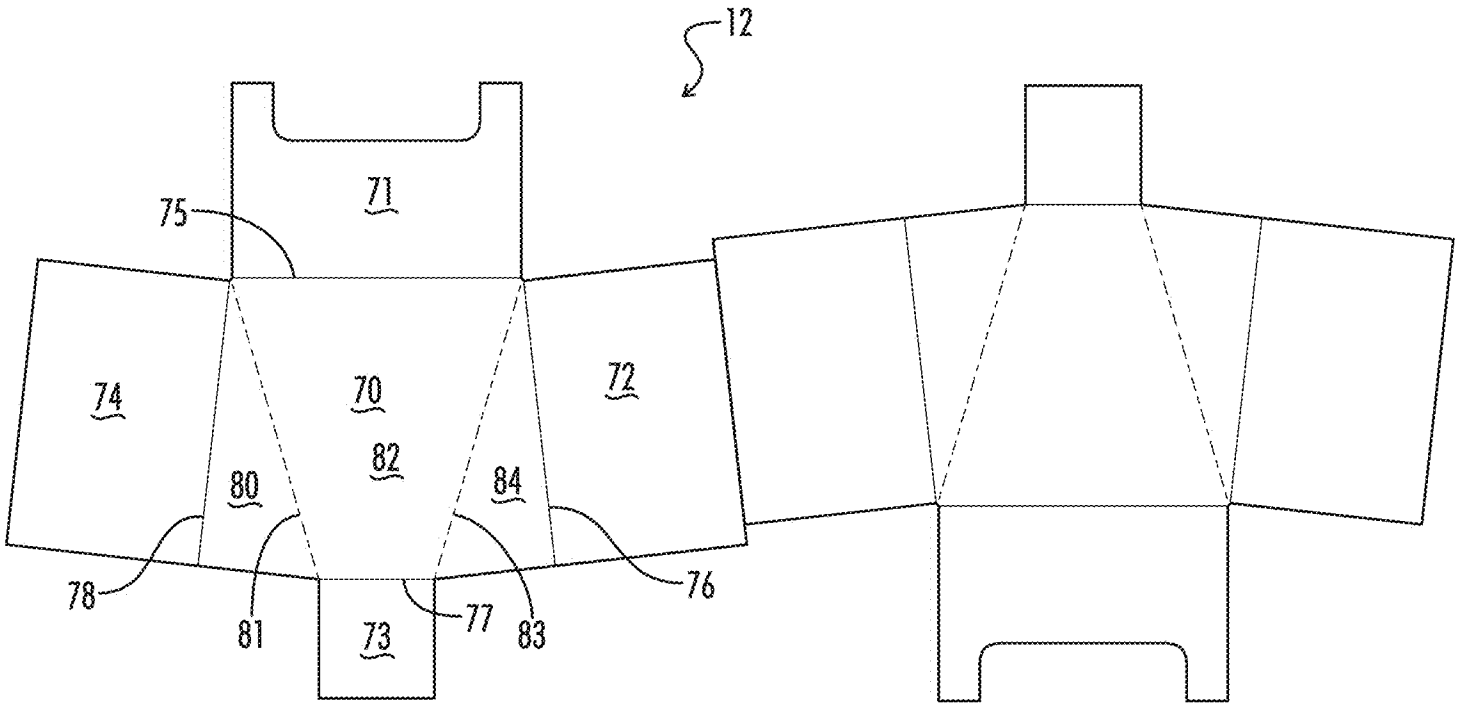
FIG. 2A is a top plan schematic view of an insert used in connection with the outer shell of FIG. 1A.
Figure 2B:
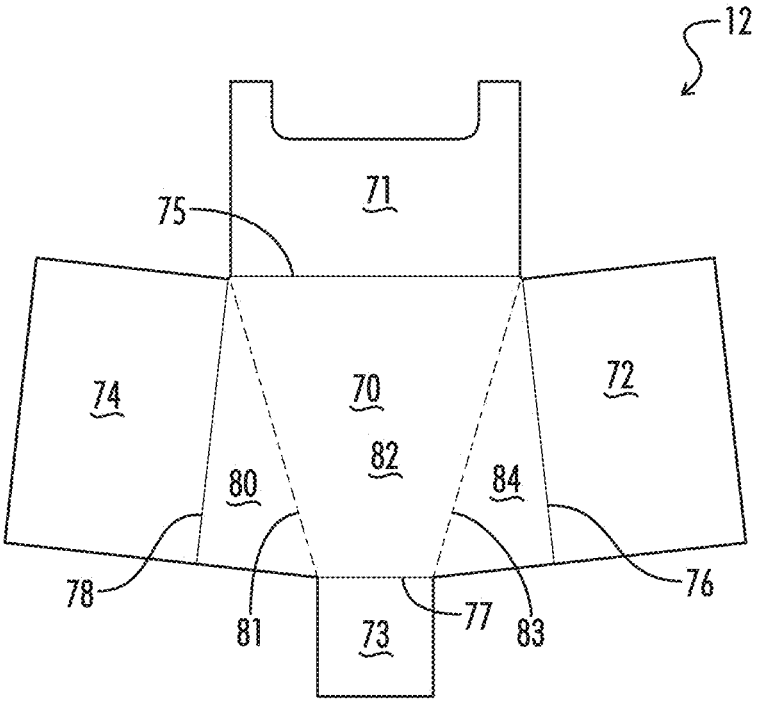
FIG. 2B is a top plan view of an insert according to FIG. 2A.
Figure 3A:
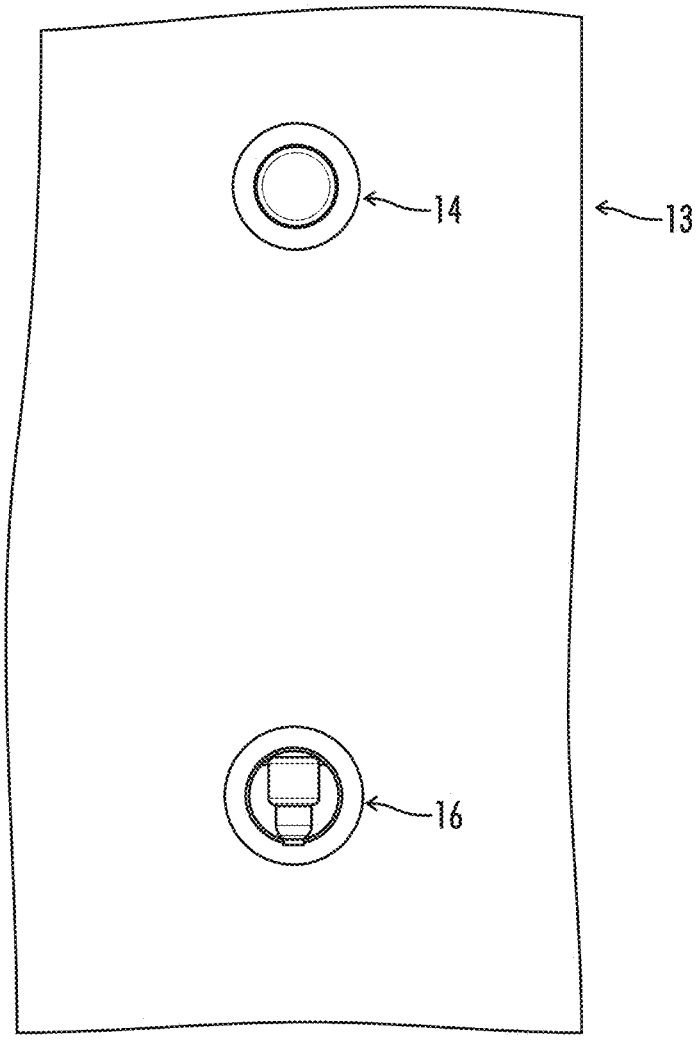
FIG. 3A is a top plan view of a plastic beverage holding bag with inlet and tap suitable for use within the outer shell of FIG. 1A.

A second component of the beverage carrier box is insert 12 depicted in FIG. 2A with center panel 70, back edge panel 11, right edge panel 72, front edge panel 73 and left edge panel 74. Edge panels 71,72,73,74 are all downwardly folding from center panel 70 along fold lines 75,76,77,78. Center panel 70 is divided into three sections including left center 80, right center 84, and center ramp section 82. Center panel 70 is also scored with fold lines 81, 83 and it can be seen that the height of front panel 73 is less than height of back panel 71 typically by about 2 to 3 inches. This enables center panel 70 to be folded downward in the center ramp area 82 along ramp folds 81, 83 to create downward sloping surface with center front fold line 77 at the low point of the entire center panel 70 and rear fold line 75 the high point of the entire center panel 70. FIG. 2B depicts an embodiment of the drawing of FIG. 2A. FIG. 3A shows a beverage bag 13 suitable for use in the outer shell 11 of FIGS. 1A, 1B, with fill cap 14 and tap 16. Suitable material for the bag 13 may depend upon its intended use. A common use is the transport of hot coffee so that a laminated bag of metalized film and other plastic layers may provide preferred heat retentive qualities, though many plastic bag constructions are possible especially if additional insulation is added to the box. The size of a bag suitable to carry three gallons of liquid would be about 18 inches wide and 24 inches tall in flattened condition. A three gallon bag when filled would typically have a weight of about 20 to 25 pounds.

Figure 3B:
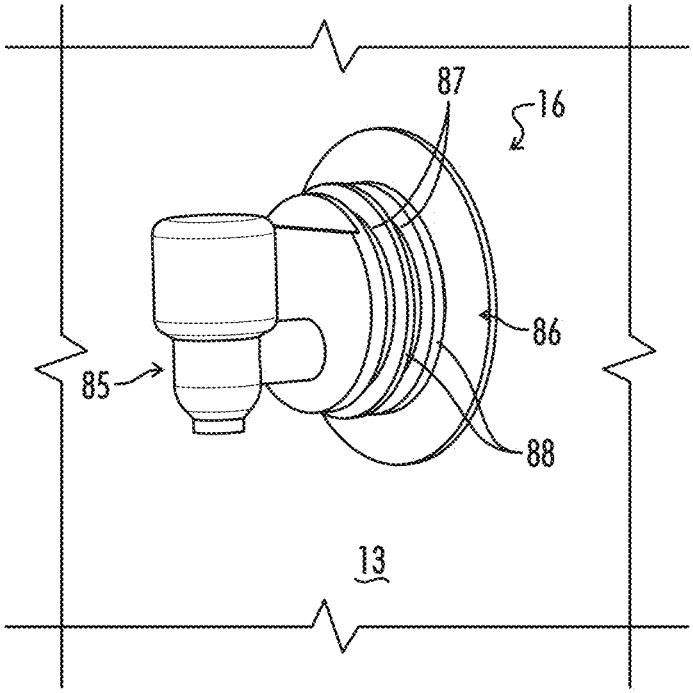
FIG. 3B is an isolation view of the tap on the bag of FIG. 3A.

FIG. 3B illustrates the tap 16 on bag 13 with a neck 86 extending from the bag to the dispenser 85. On the neck 86 are preferably one or more flanges 88 that create one or more channels 87. Channels 87 can be utilized to mount the tap 16 on the edges of front shell panel 40 adjacent to the tap opening 60.

Figure 4:
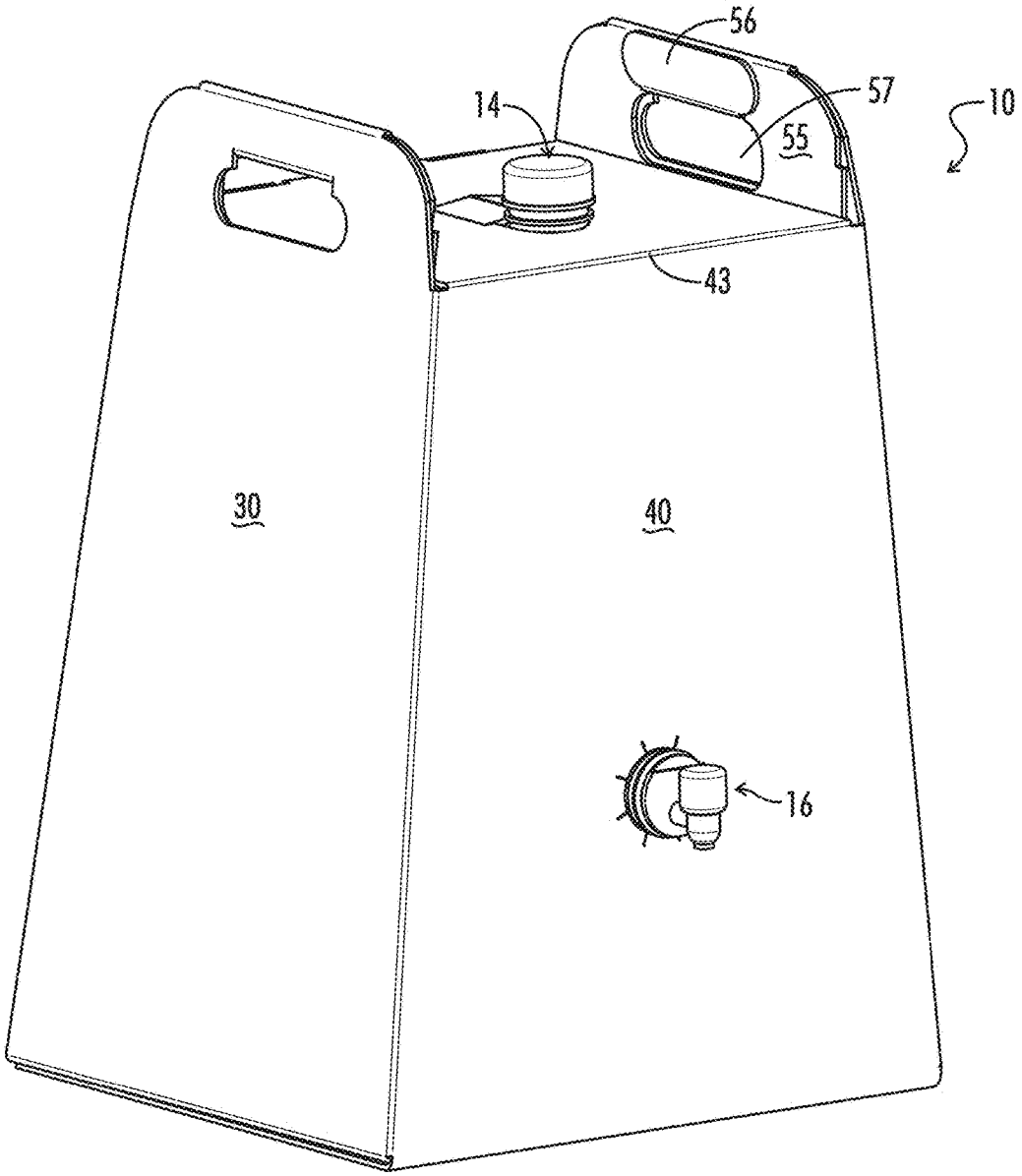
FIG. 4 is a perspective view of an assembled oversize beverage carrier box.
Figure 5:
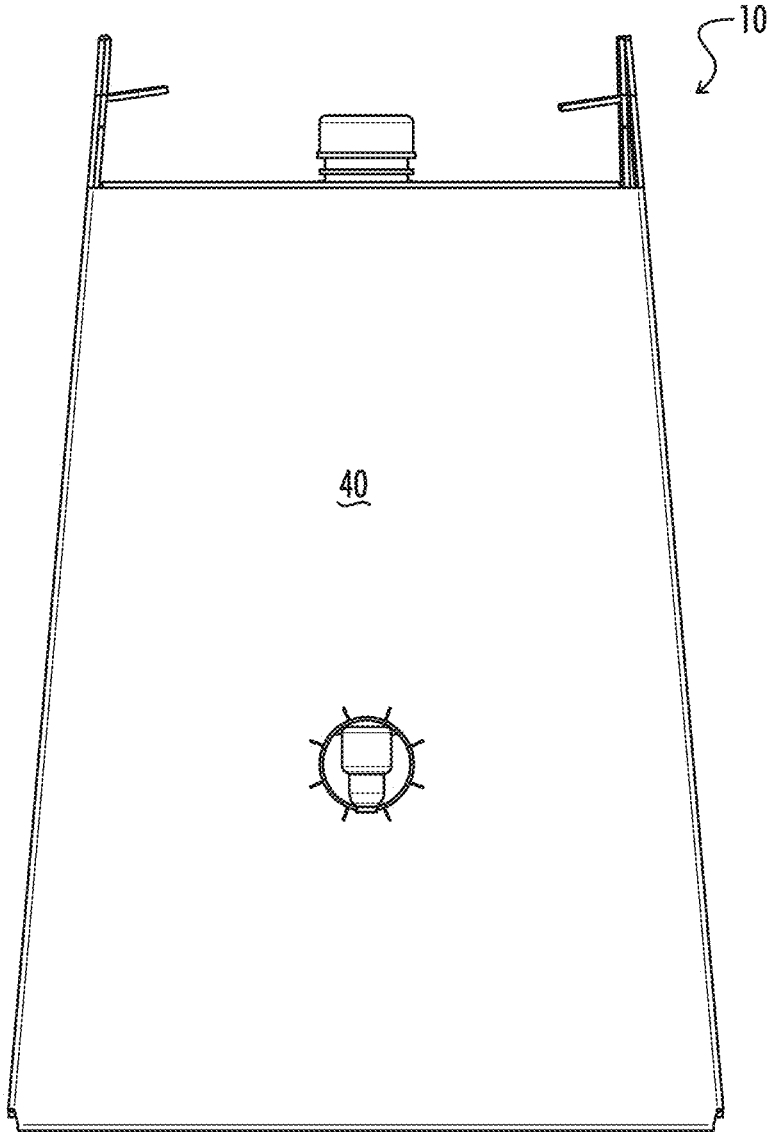
FIG. 5 is a front elevation view of the oversize beverage carrier box of FIG. 4.
Figure 6:
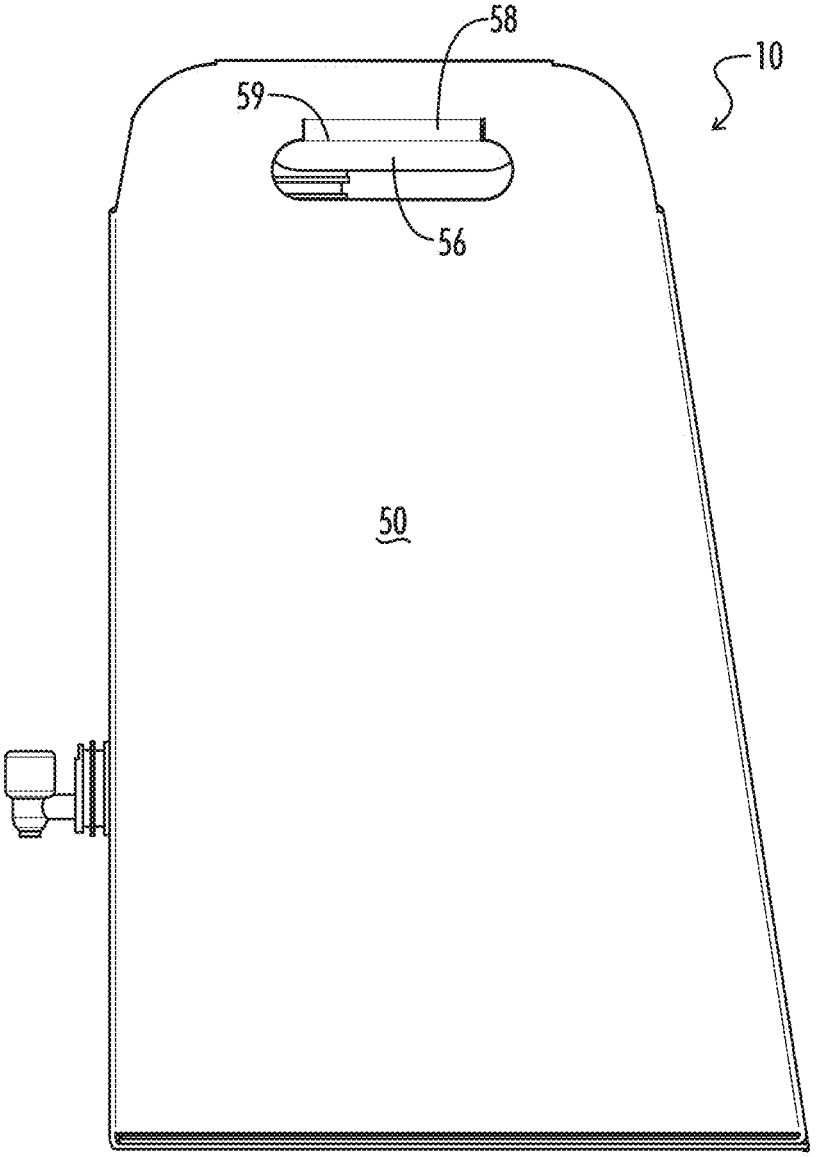
FIG. 6 is a right side elevation view of the oversize beverage carrier box of FIG. 4.
Figure 7:
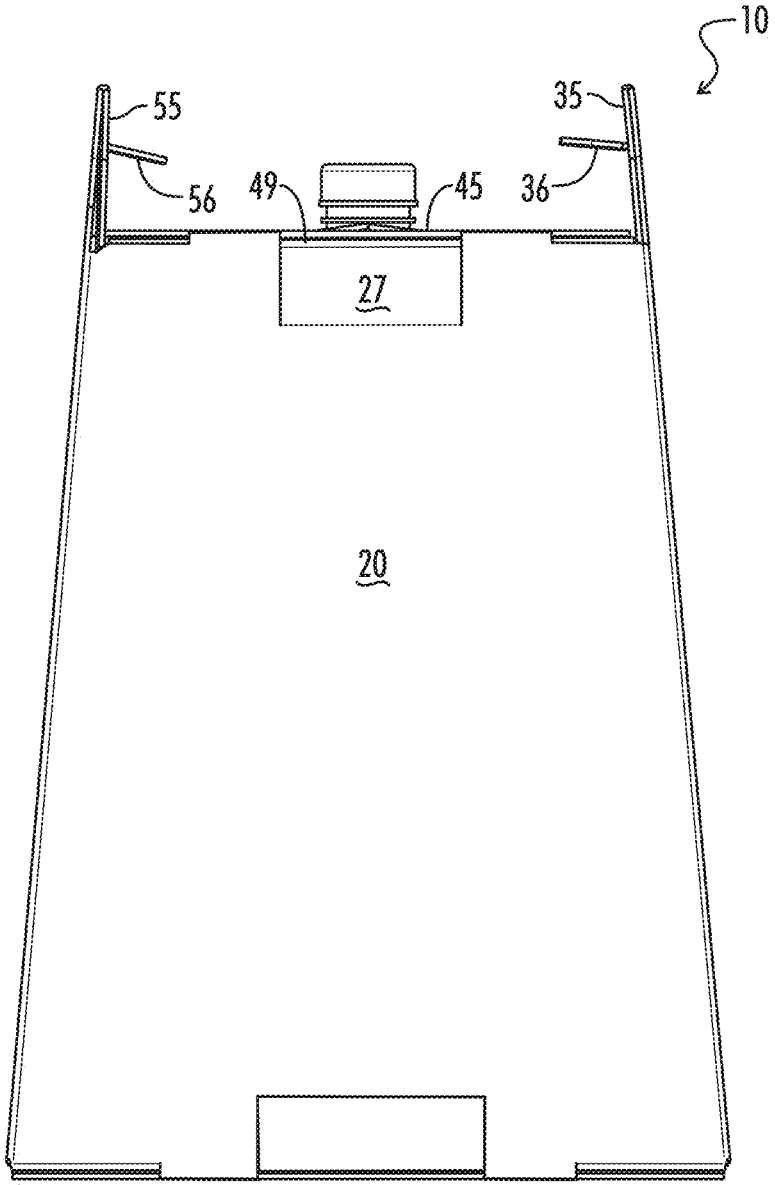
FIG. 7 is a rear elevation view of the oversize beverage carrier box of FIG. 4.
Figure 8:
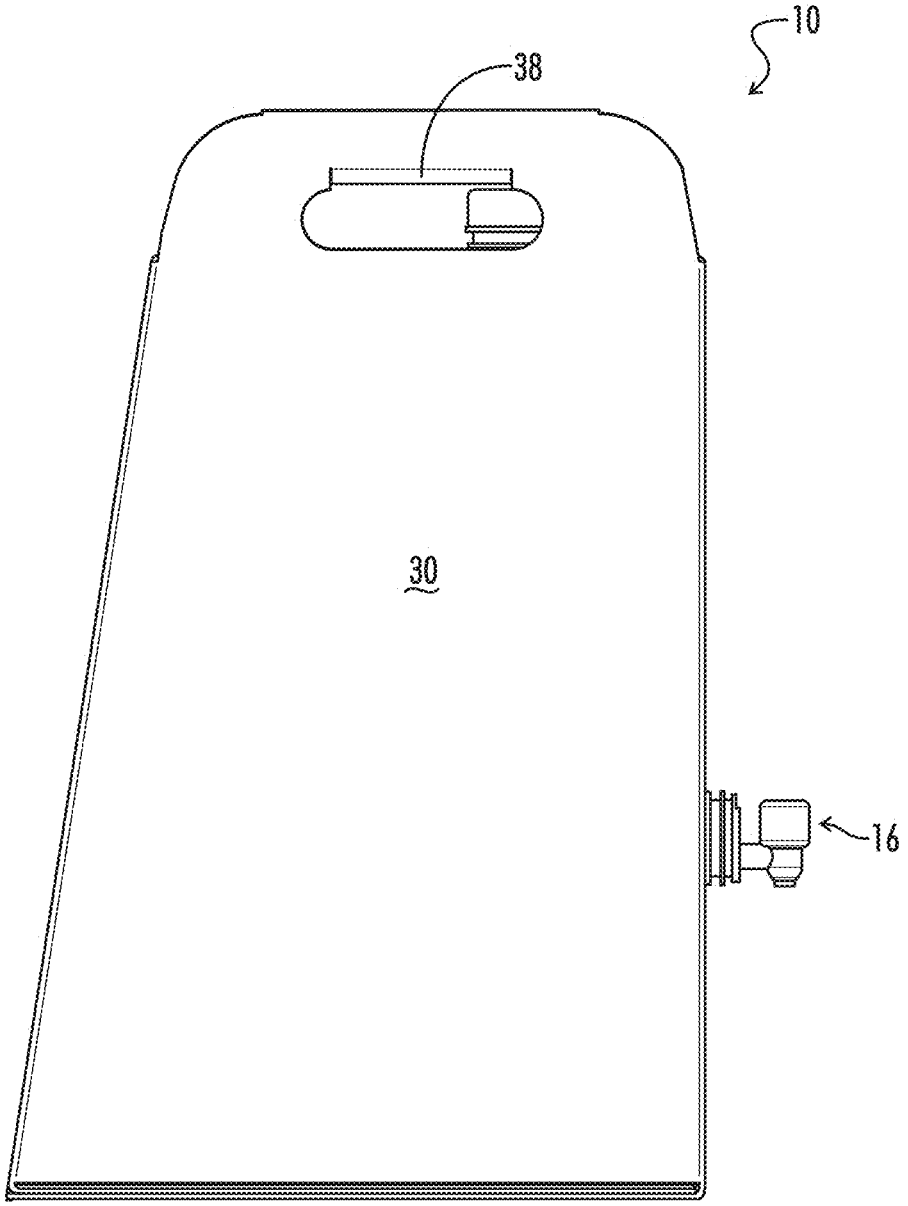
FIG. 8 is a left elevation view of the oversize beverage carrier box of FIG. 4.
Figure 9:
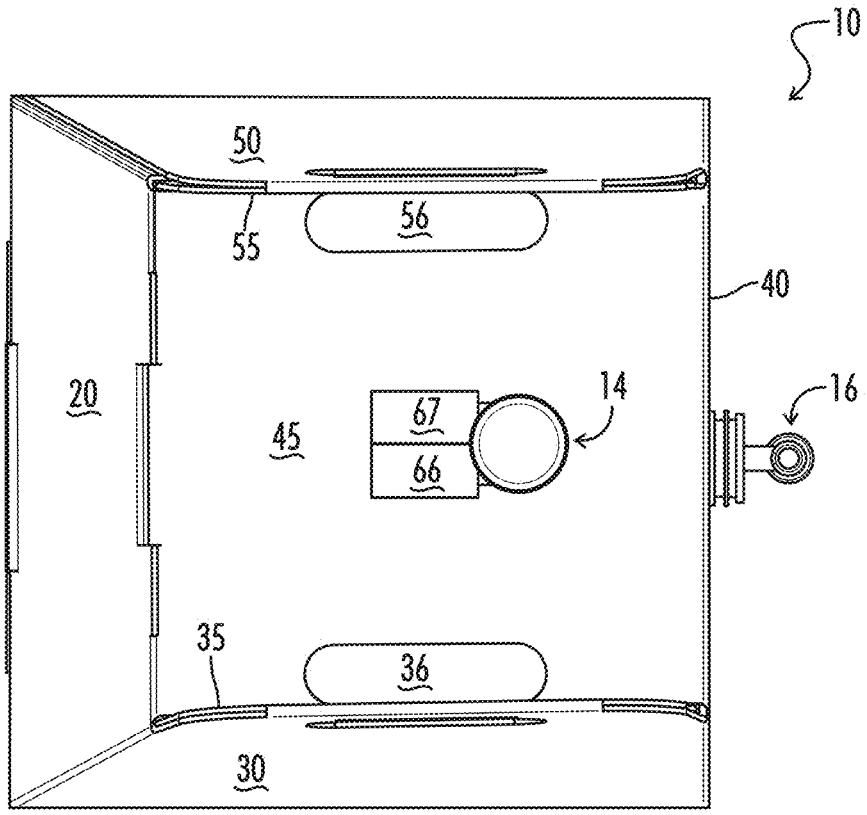
FIG. 9 is a top plan view of the oversize beverage carrier box of FIG. 4.
Figure 10:
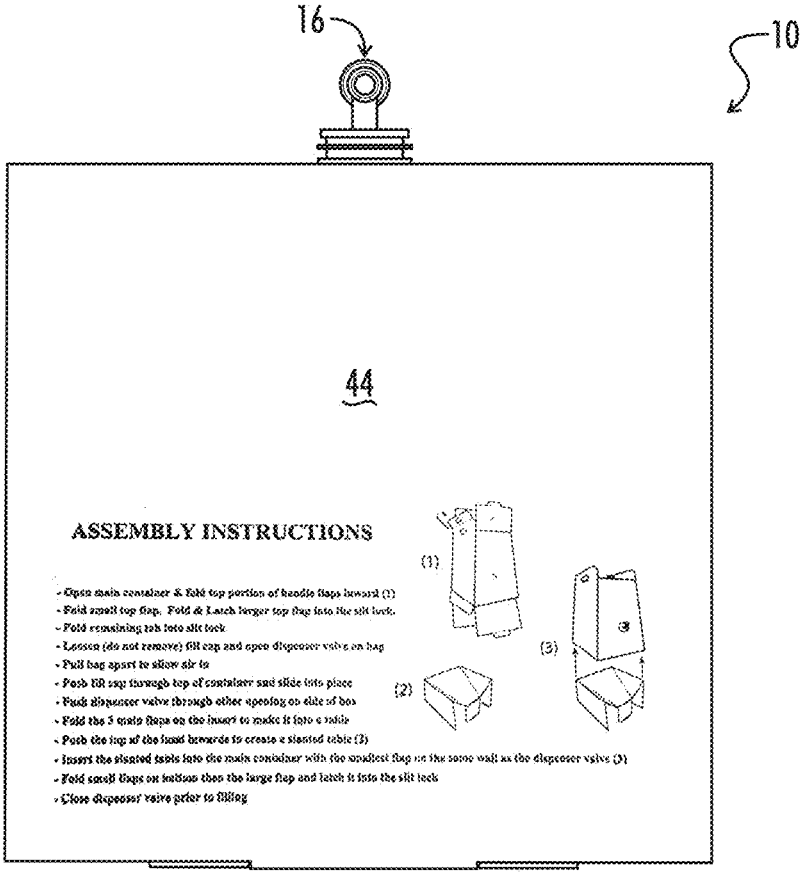
FIG. 10 is a bottom plan view of the oversize beverage carrier box of FIG. 4.

FIG. 4 is a perspective illustration of a fully assembled beverage carrier box 10 according to aspects of the invention and particularly illustrates the right handle tab 56 being inserted through right handle opening 57 to hold right top handle panel 55 against the upper portion of right shell panel 50 and provide a more comfortable carrying grip by passing the neck 58 through right handle opening 57.

FIGS. 5 through 10 are plan views of the beverage carrier box of FIG. 4 from all sides.

FIGS. 11A through 11E depict the assembly of the beverage box container from its components, the outer shell 11, bag 13, and insert 12. As an initial step, the outer shell is opened from its flattened position depicted in FIG. 1B. The top of the container is identified as the smaller end with handles. The handle tabs 35,55 are folded downward so that the handle openings 37,57 are aligned with the handle tabs 36,56 and the tabs 36,56 are pushed through the handle openings 37,57 and folded upward.

Next, the top of the outer shell is formed by folding down the rear top panel 25 and then folding down the front top panel 45 and inserting front top panel tab 47 into rear top slit 29. This forms a first vertical latch. Then the rear top tab 27 is folded outward along fold 127 and inward along fold 129 and inserted into front top slit 39. This forms a horizontal latch so that the vertical and horizontal latching securely fastens the top of the outer shell.

Next, the plastic bag 13 has its fill cap 14 screw top loosened, although not removed and the tap or dispenser 16 is opened. The bag walls are pulled apart to allow air in, especially near the fill cap. This will make the plastic bag easier to handle during the subsequent beverage filling process.

Next, the fill cap 14 on the plastic bag 13 is pushed through the top arched opening 65, and particularly the part of the opening covered by top left arch tab 66 and top right arch tab 67. The fill cap 14 should be pushed through the opening until a flange 91 defining a channel 90 is passed through the opening 65 and moved towards the curved arched position of opening 65 where the edges of front top panel 45 engage in the channel 90. Tabs 66, 67 can then be closed to fix the position of the fill cap 14 against the curved edge of the opening 65. Next, the tap 16 is pushed through tap opening 60 in front shell panel 40. Cut lines 61 enable the opening 60 to expand and allow the passage of flanges 88 that define one or more channels 87. When the tap 16 is positioned as desired, the tabs between cut lines 61 will inter-fit within a channel 87 and hold the neck 86 of the tap 16 in position.

Figure 11A:
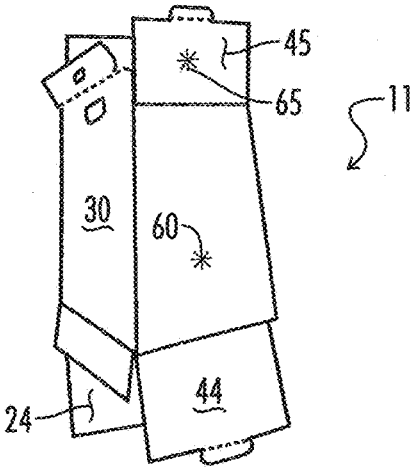
FIGS. 11A-11E are schematic sequential assembly diagram of an oversize beverage carrier box.
Figure 11B:
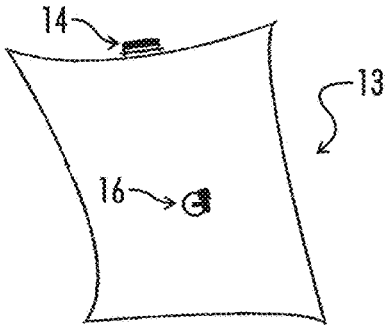
Figure 11C:
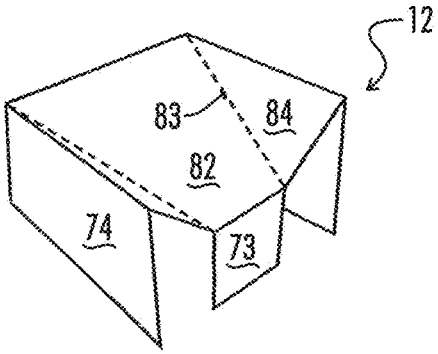
Figure 11D:
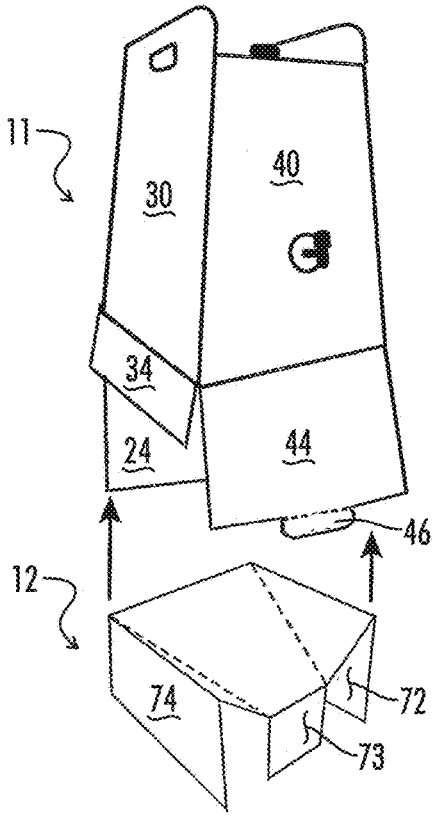
Figure 11E:
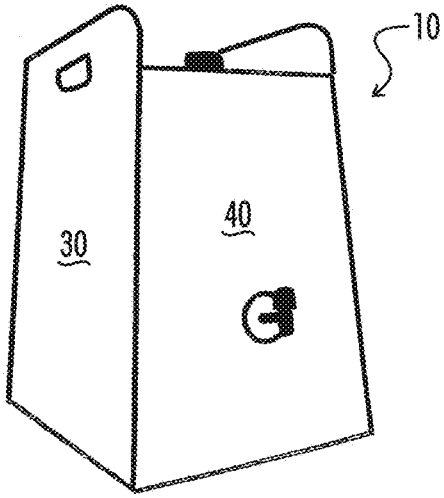
Figure 12:
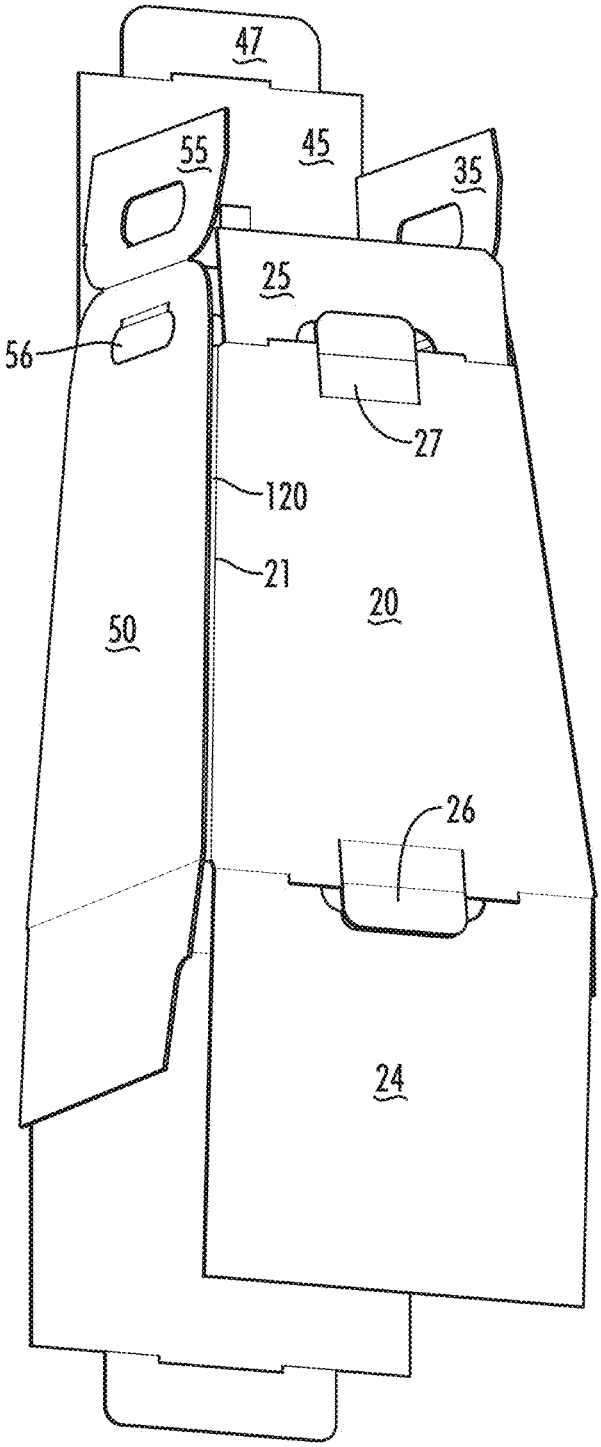
FIG. 12 is a side angle view of the fastened outer shell in its opened position.
Figure 13:
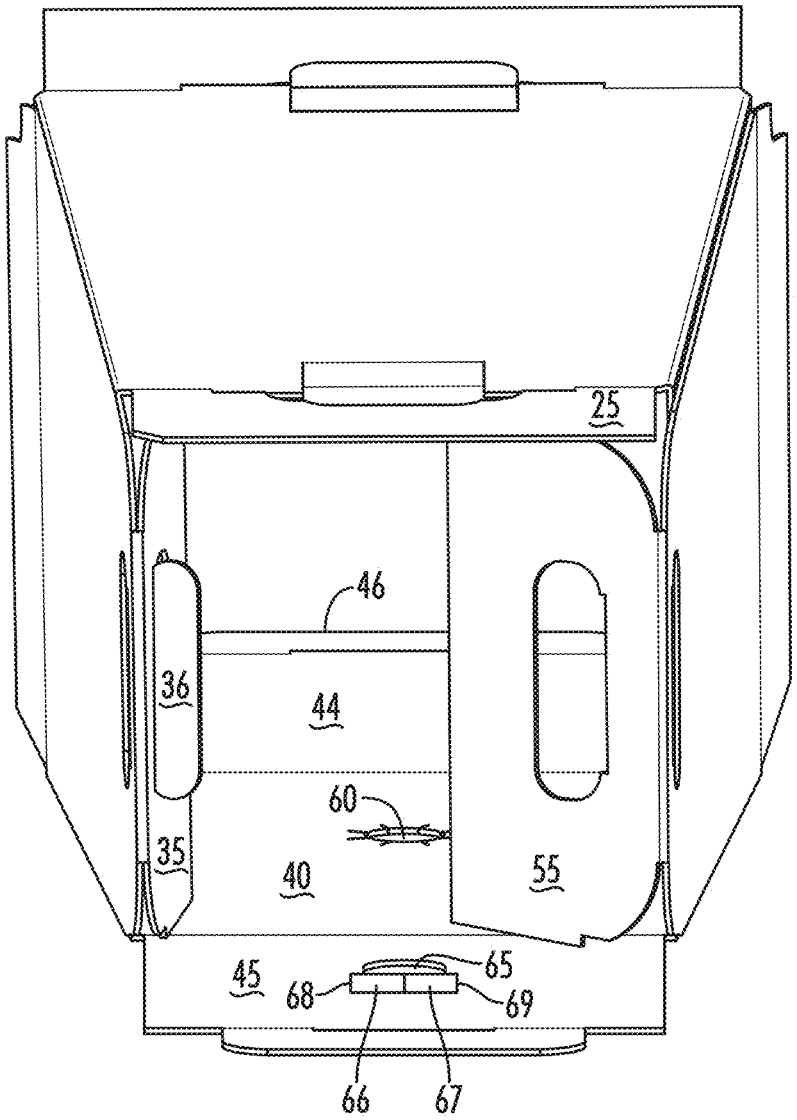
FIG. 13 is a top perspective view of the handle structure of the outer shell.
Figure 14:
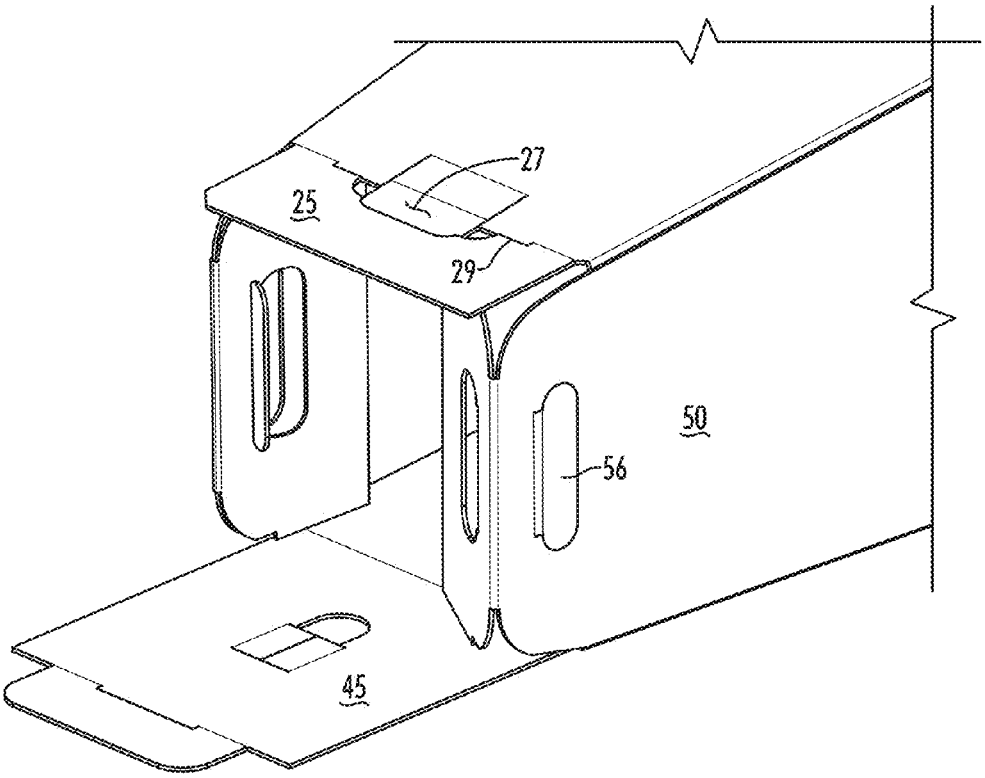
FIG. 14 is a right side perspective view of the handle structure of the outer shell.
Figure 15:
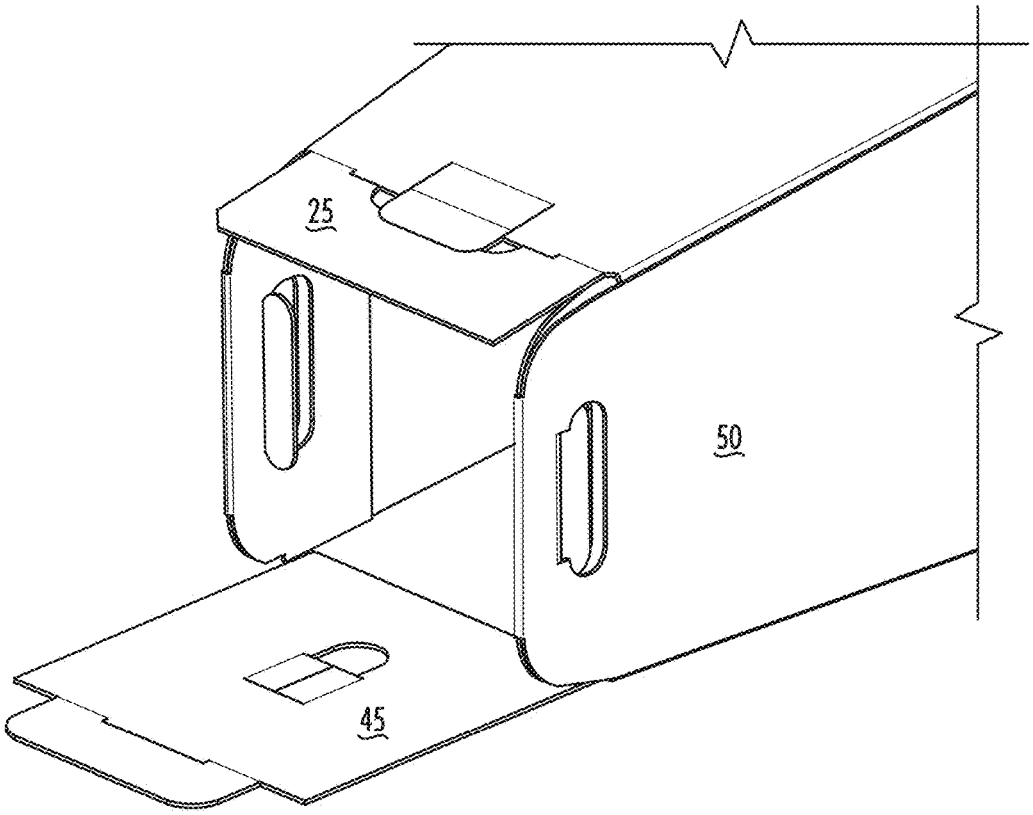
FIG. 15 is a second right side perspective view of the handle structure of the outer shell.
Figure 16:
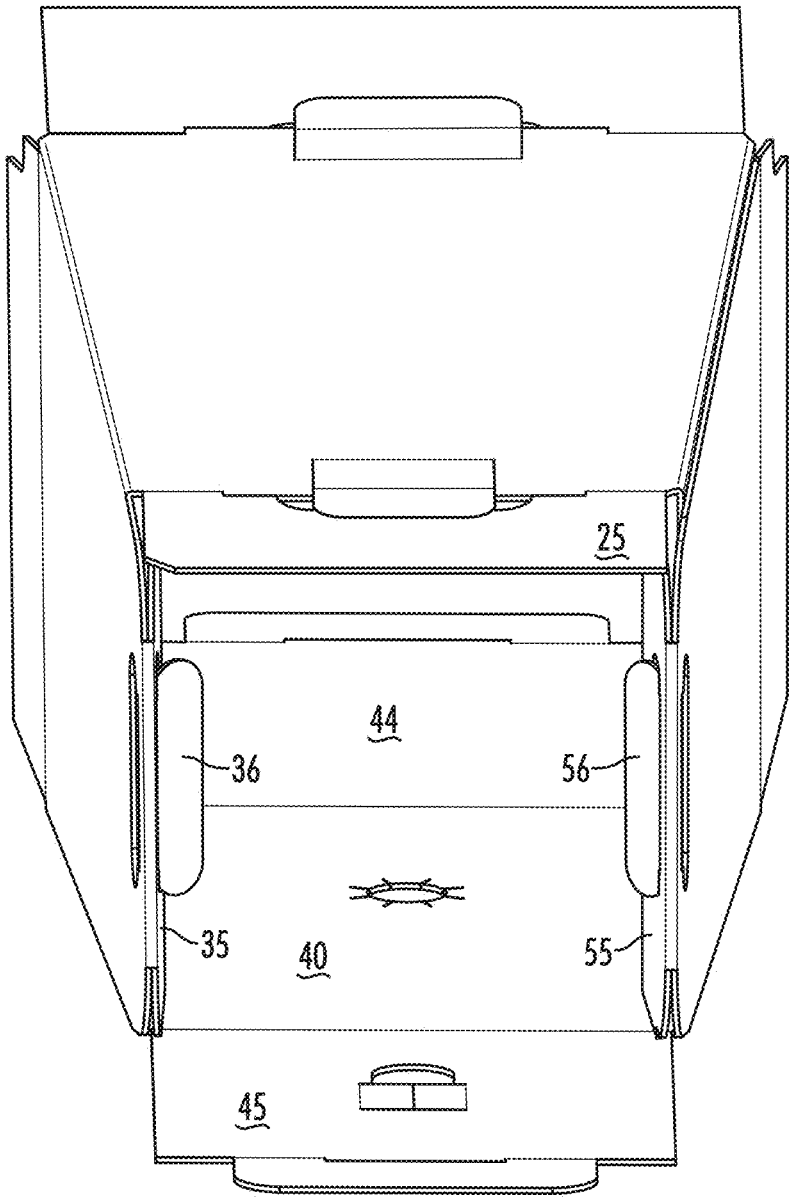
FIG. 16 is a top perspective view of the completed handle structure of the outer shell.
Figure 17:
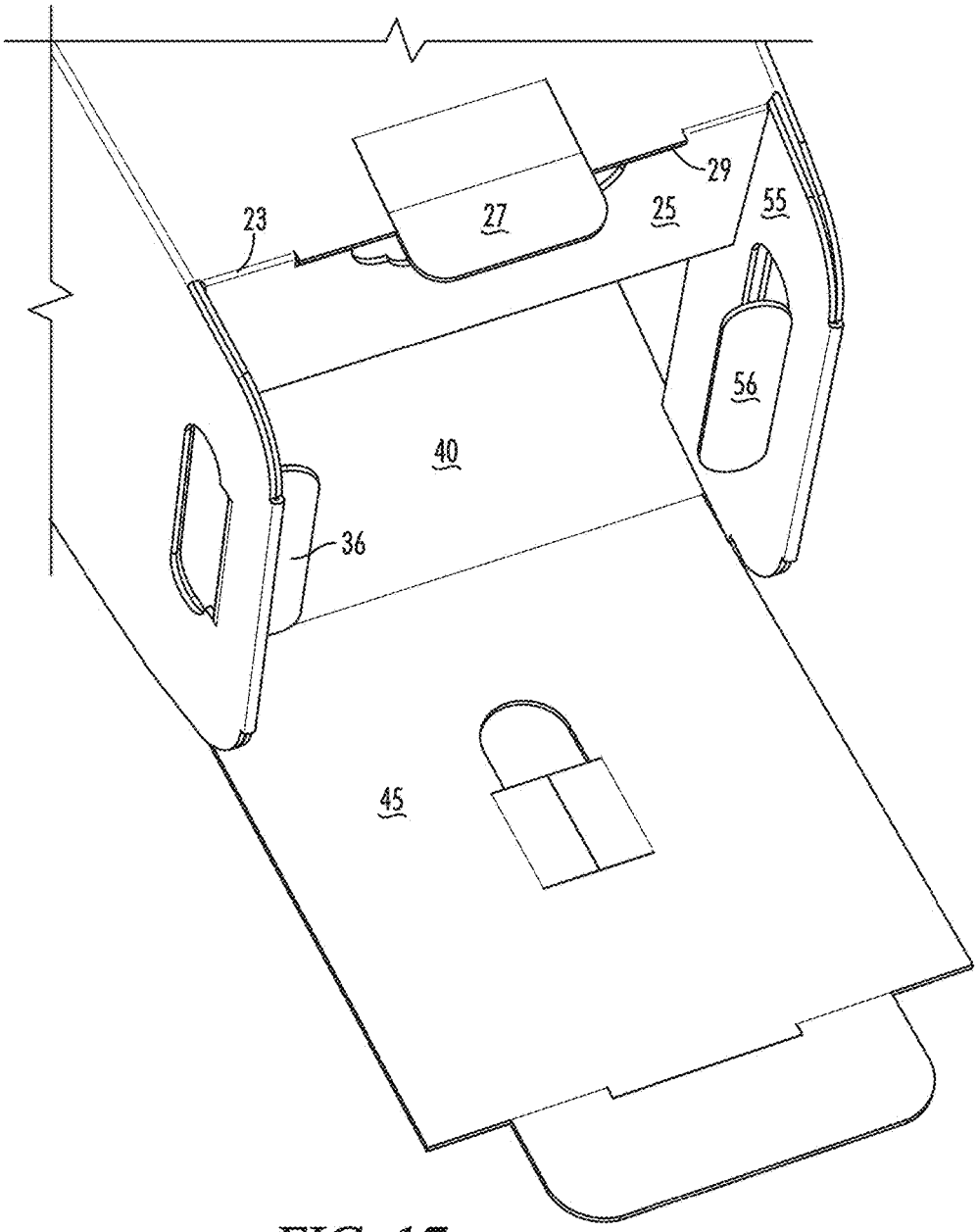
FIG. 17 is a top perspective view of the handle structure of the outer shell with the small flap folded.
Figure 18:
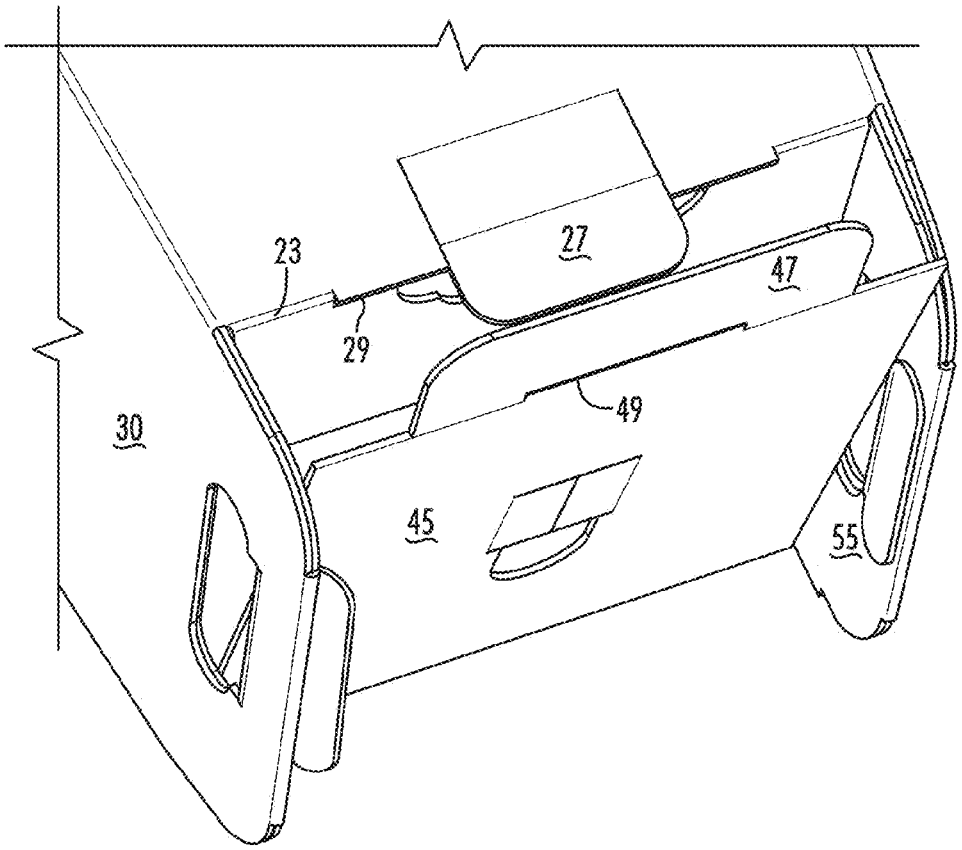
FIG. 18 is a top perspective view of the handle structure of the outer shell with the large flap closing.
Figure 19:
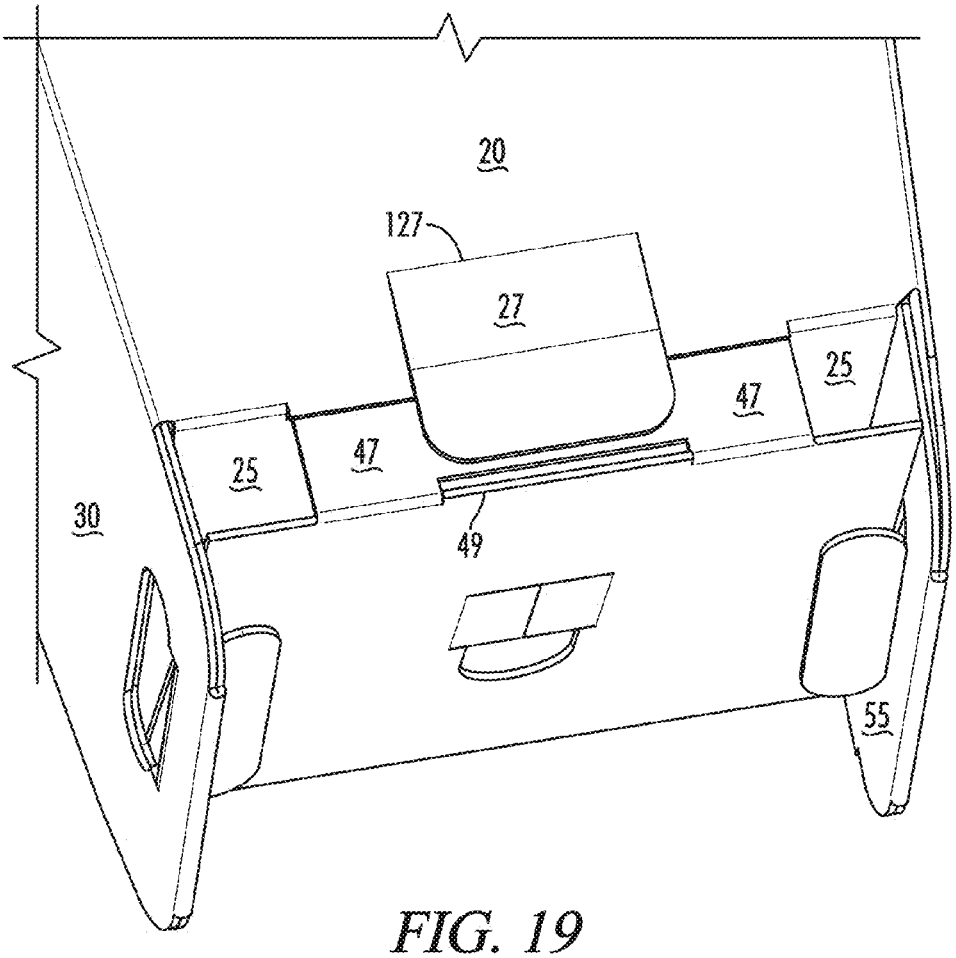
FIG. 19 is a top perspective view of the latching assembly of the large top panel in a partially closed position.
Figure 20:
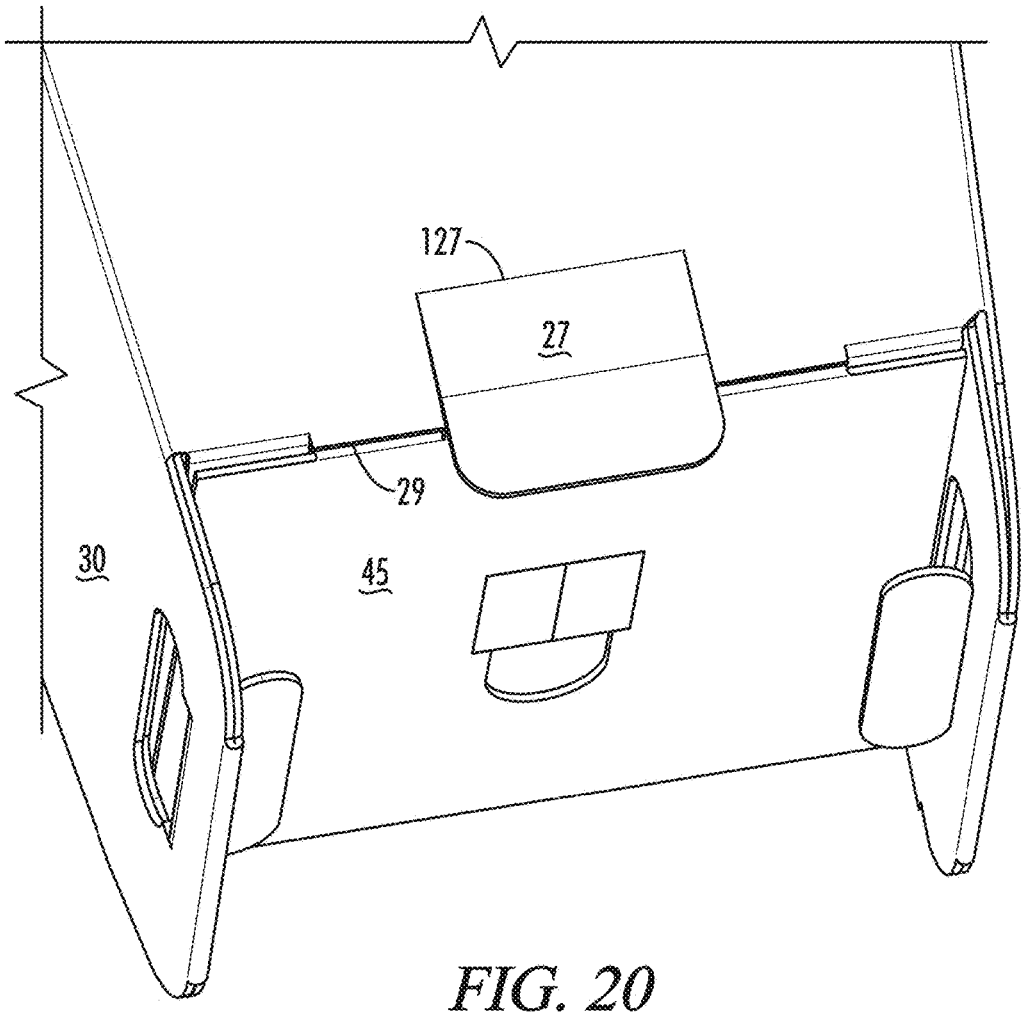
FIG. 20 is a top perspective view of the latching assembly of the large top panel in a fully closed position.
Figure 21:
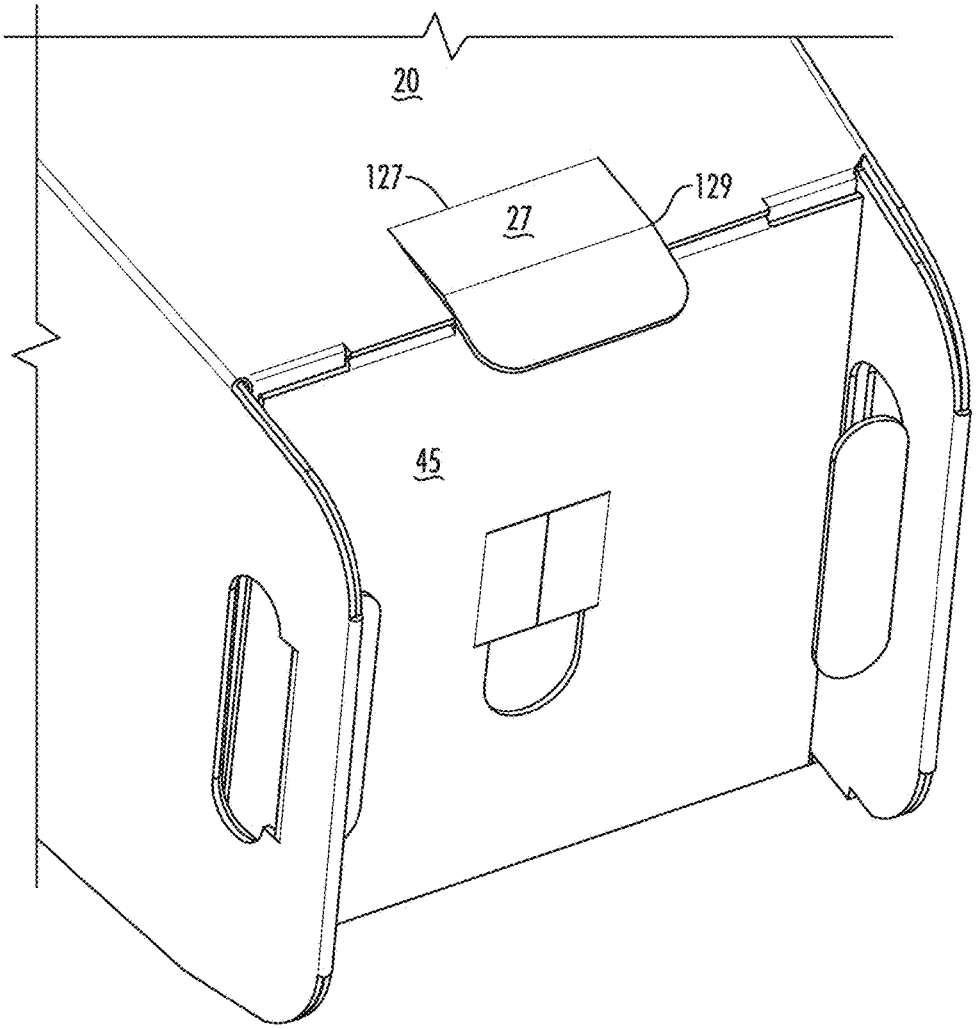
FIG. 21 is a top perspective view of the latching assembly for the large top panel with folded main body latch.
Figure 22:
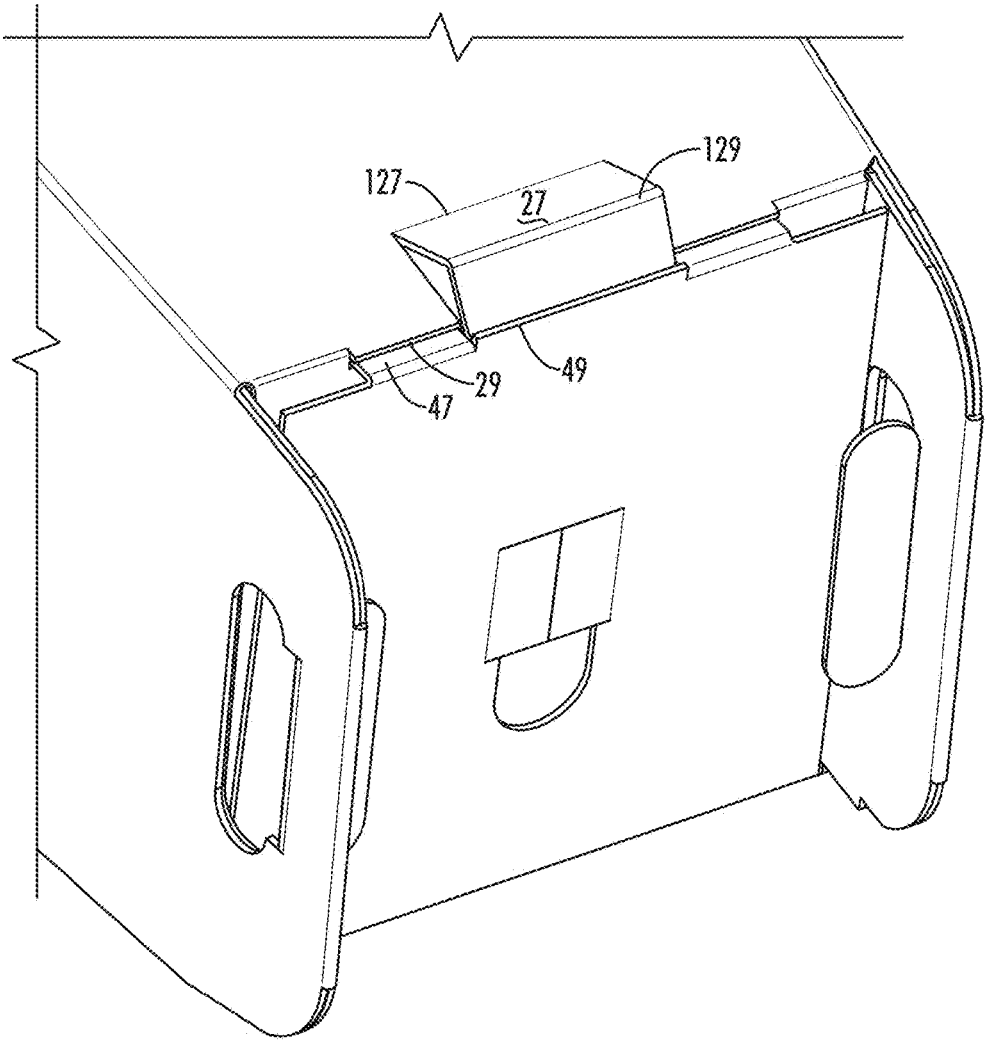
FIG. 22 is a top perspective view of the latching assembly for the large top panel with folded main body latch partially inserted in the top panel slit.
Figure 23:
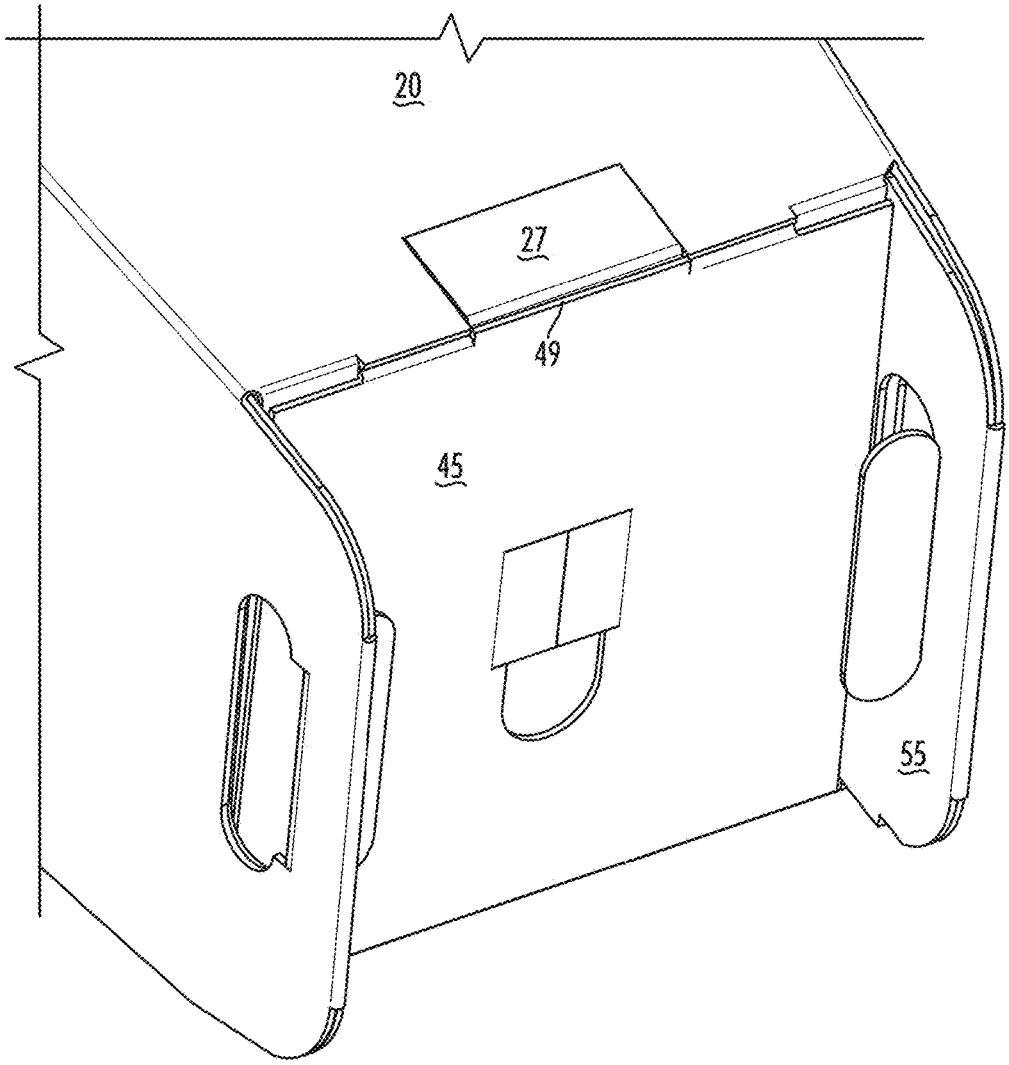
FIG. 23 is a top perspective view of the latching assembly for the large top panel with folded main body latch fully inserted in the top panel slit.
Figure 24:
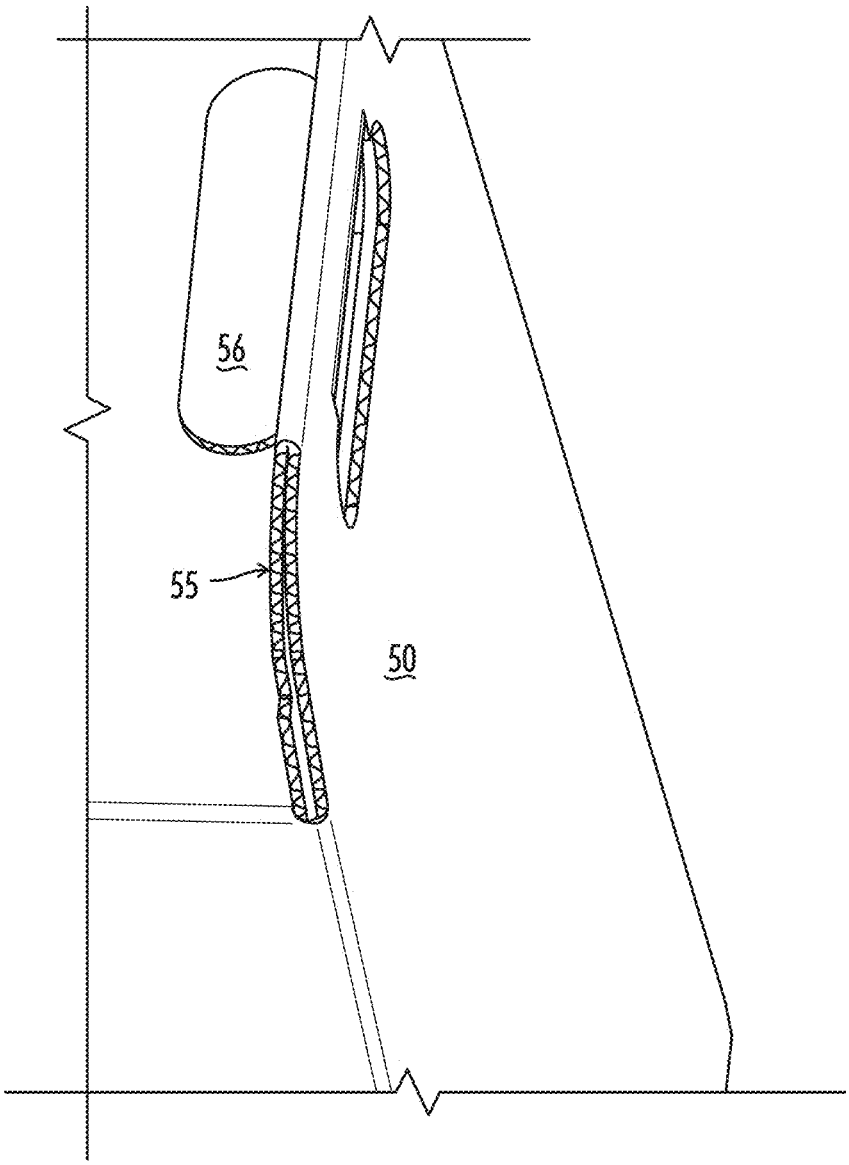
FIG. 24 is an isolation view of the double panel handle assembly.
Figure 25:
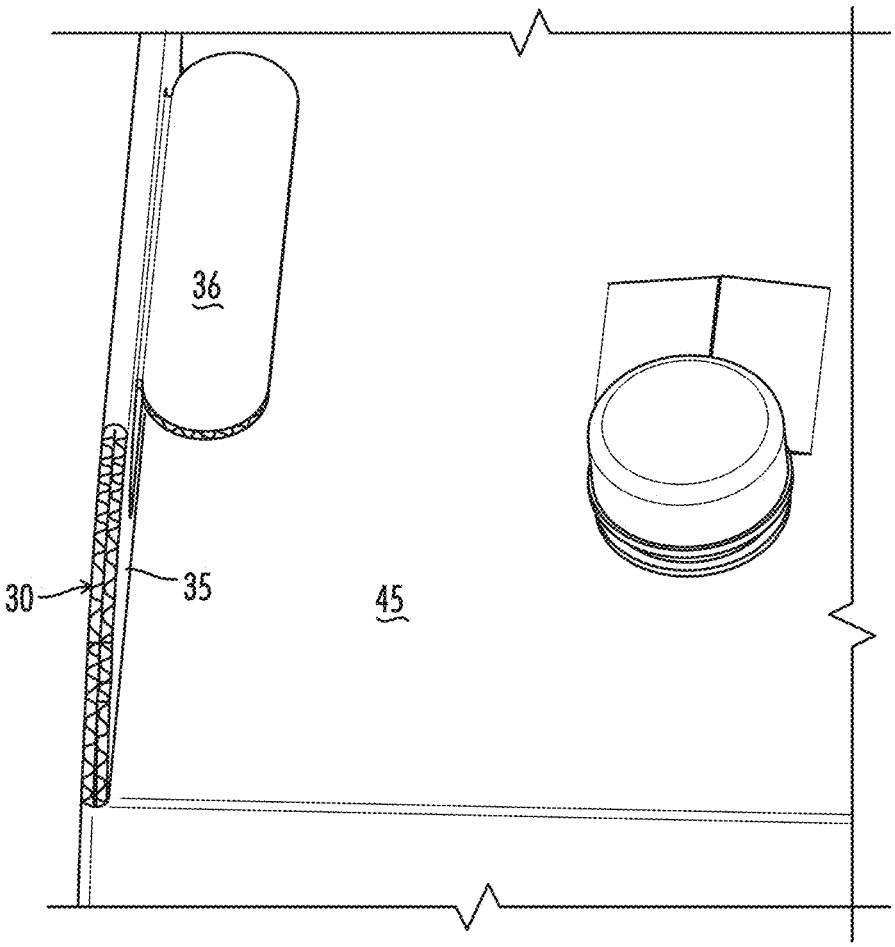
FIG. 25 is a reverse angle view of the double panel handle assembly.
Figure 26:
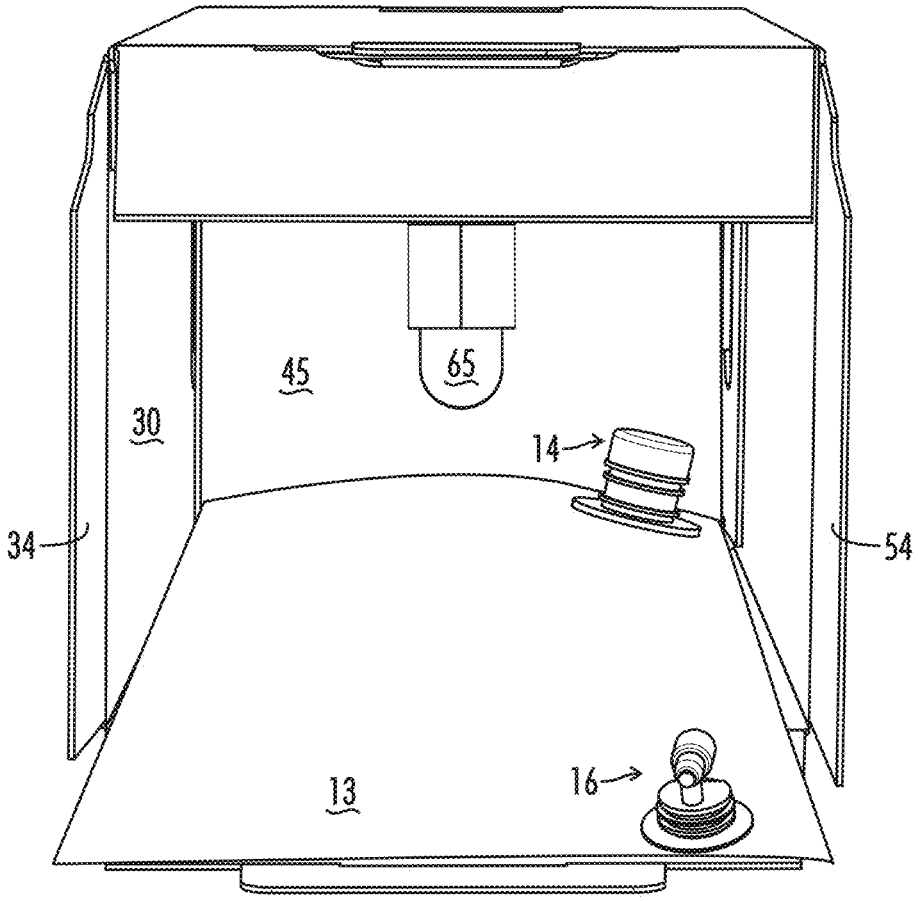
FIG. 26 is a bottom perspective view of the bag placed within the outer shell with latched top.
Figure 27:
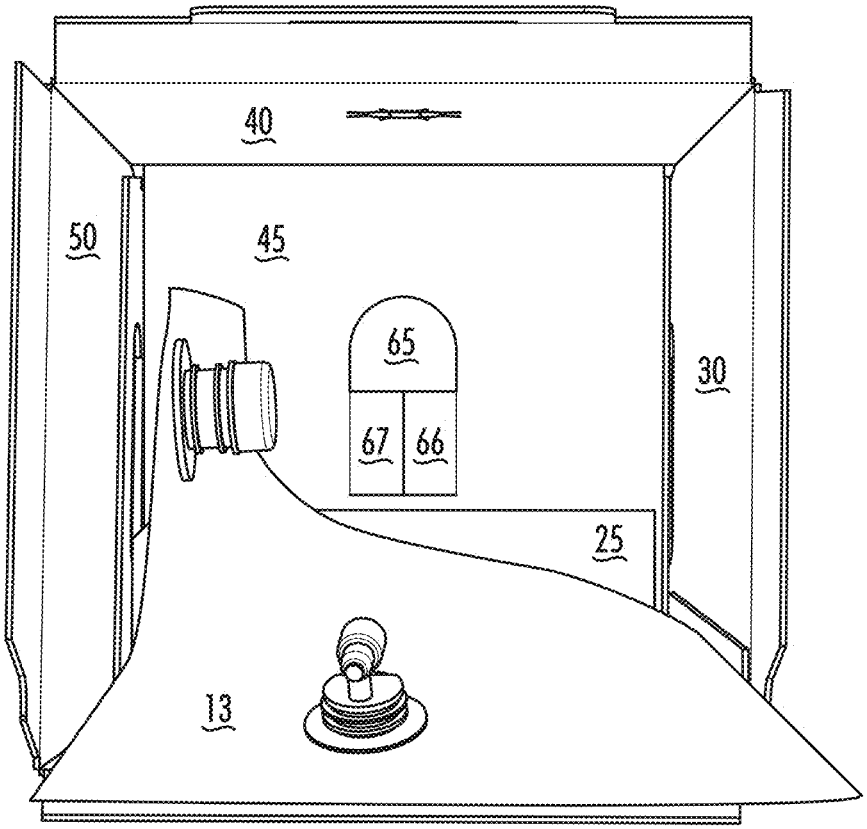
FIG. 27 is an alternative view of the bag assembly placed within the outer shell with latched top.
Figure 28:
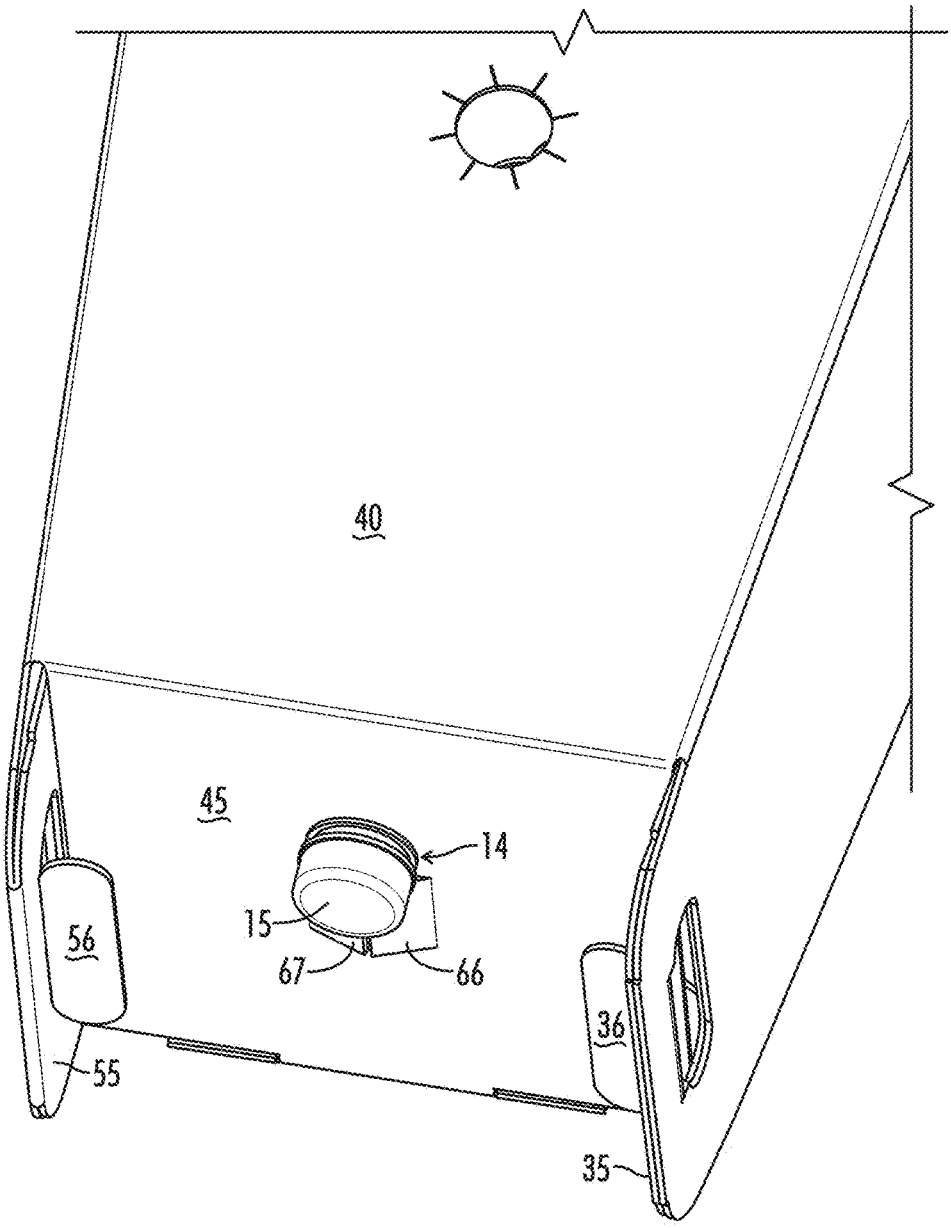
FIG. 28 is a top perspective view of the fill cap of the bag inserted through the top panel of the outer shell.
Figure 29:
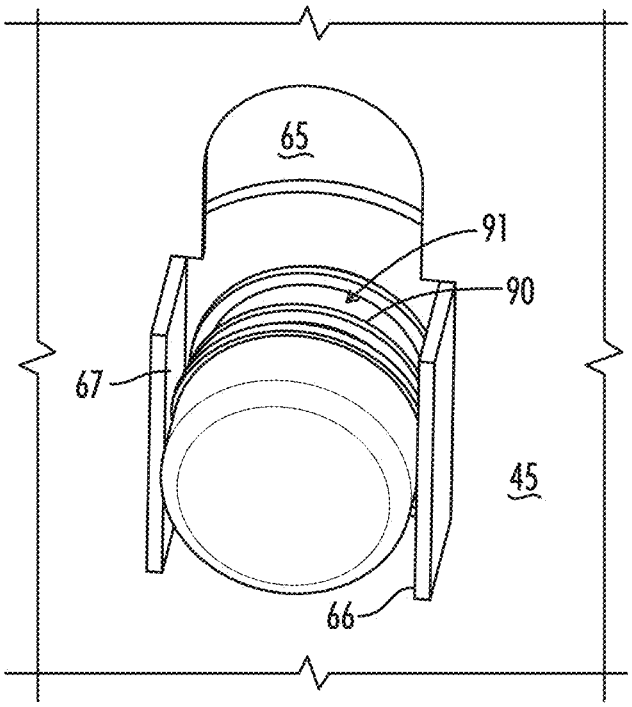
FIG. 29 is an isolation view of the fill cap inserted through a rectangular opening in the top panel.
Figure 30:
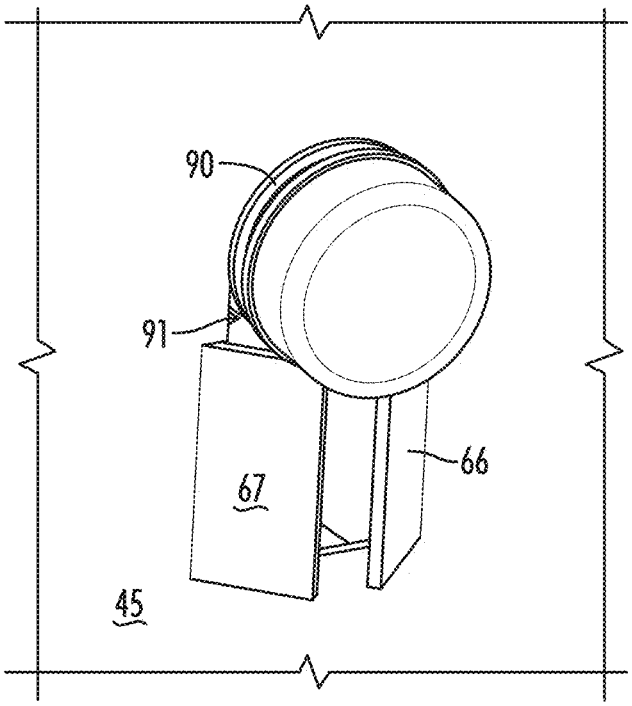
FIG. 30 is an isolation view of the fill cap neck positioned within an arched section of the opening in the top panel of the outer shell.
Figure 31:
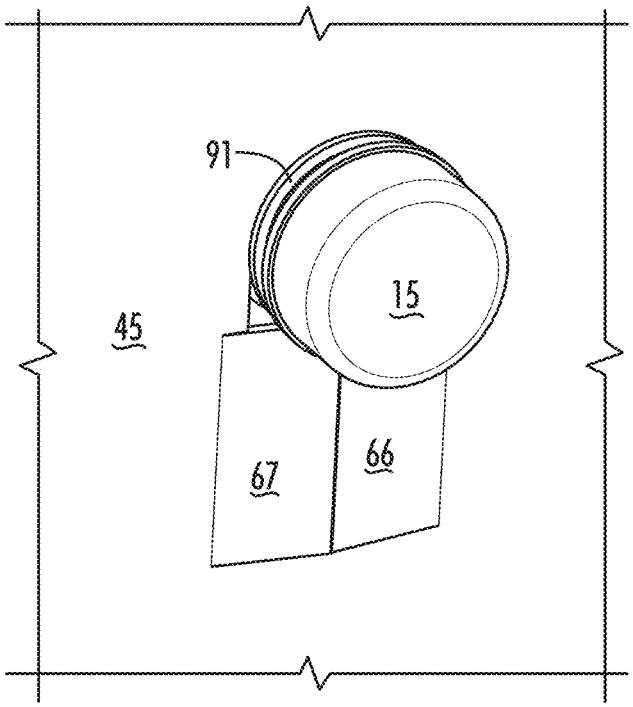
FIG. 31 is an isolation view of the fill cap neck locked in the arch portion of the opening in the outer shell top panel.
Figure 50:
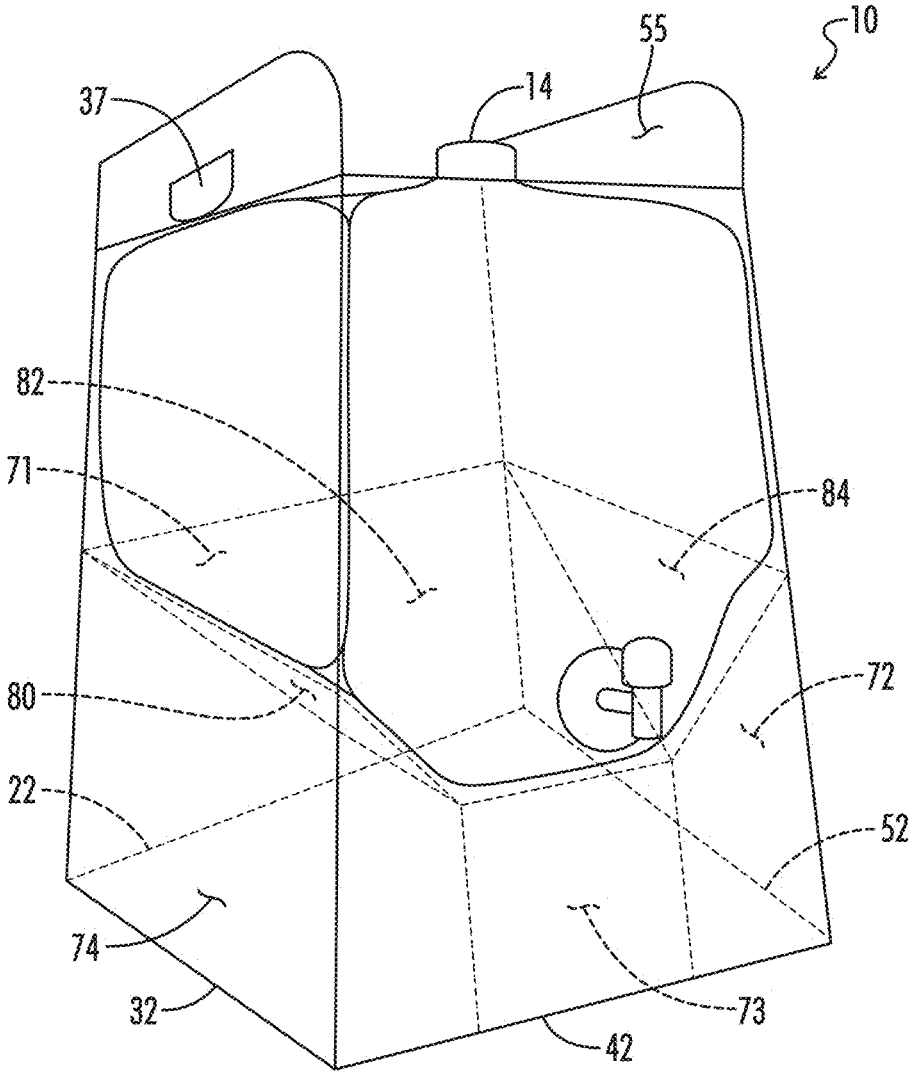
FIG. 50 is a phantom perspective view of an assembled oversize beverage carrier box with dashed lines depicting the insert and showing the bag position within the box.

Next, the insert 12 is folded with back edge panel, right edge panel, front edge panel and left edge panel 71,72,73,74 folded downward. Then the center ramp section 82 of center panel 70 is pushed downward so that left center 80 and right center 84 downwardly slope towards the center ramp 82. In addition, because the back edge panel 71 is taller than the front edge panel 73, the center ramp 82 downwardly slopes from center back fold 75 to center front fold 77. As shown in FIG. 11D, the folded insert 12 is positioned within the bottom opening of the outer shell 11 with front edge panel 73 fitting behind front shell panel 40. Correspondingly, back edge panel 71 fits within rear shell panel 20, right edge panel 72 fits within right shell panel 50, and left edge panel 74 fits within left shell panel 30. When so positioned, the center ramp 82 forms a base upon which the bag 13 can rest and gravitationally urges contents of bag 13 toward the front panel 40 and tap 16. Similarly, left center panel 80 and right center panel 84 of the insert gravitationally urge contents of bag 13 toward the center ramp section 82. In this fashion, as shown in the phantom illustration of FIG. 50, most contents of the bag 13 are urged to the tap 16 from the sides and from the rear.

After the insert 12 is placed within the opening of outer shell 11, the outer shell is closed. Typically, left bottom panel 34 and right bottom panel 54 are closed across the opening along bottom folds 32,52 and rear bottom panel 24 is closed over left and right bottom panels 34,44. Last, the front bottom panel 44 is closed with front bottom panel tab 46 inserted in rear bottom slit 28 to form a vertical latch. Then rear bottom tab 26 is folded away from rear shell panel 20 along fold line 126 and forward along fold line 128 to insert the distal end of rear bottom tab 26 into bottom tab slot 48 of front bottom panel 44 forming a horizontal latch. As was the case with the top, the vertical and horizontal latching mechanisms securely fasten the bottom of the box. When the bag 13 is positioned and the top and bottom closed, the resulting beverage container box substantially encases the bag 13 to minimize thermal changes to the contents. The only air exchange around the bag 13 is whatever air can flow through the small seams where the fill cap 14, tap 16, and top panels 25, 35, 45, 55 and bottom panels 24, 34, 44, 54 interface. No handholds or other significant openings provide access to the bag 13.

Figure 32:
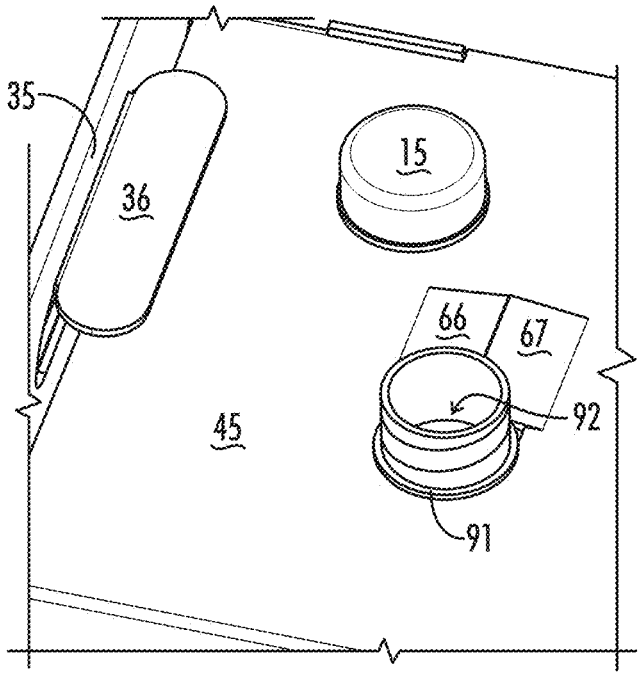
FIG. 32 is an isolation view of the fill cap with screw top removed for filling.
Figure 33:
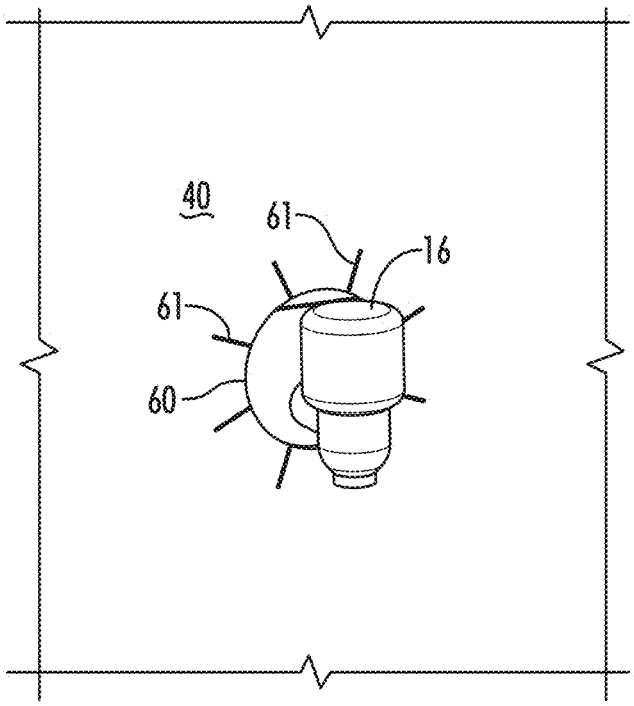
FIG. 33 is a front elevation view of tap partially inserted in the front panel opening.
Figure 34:
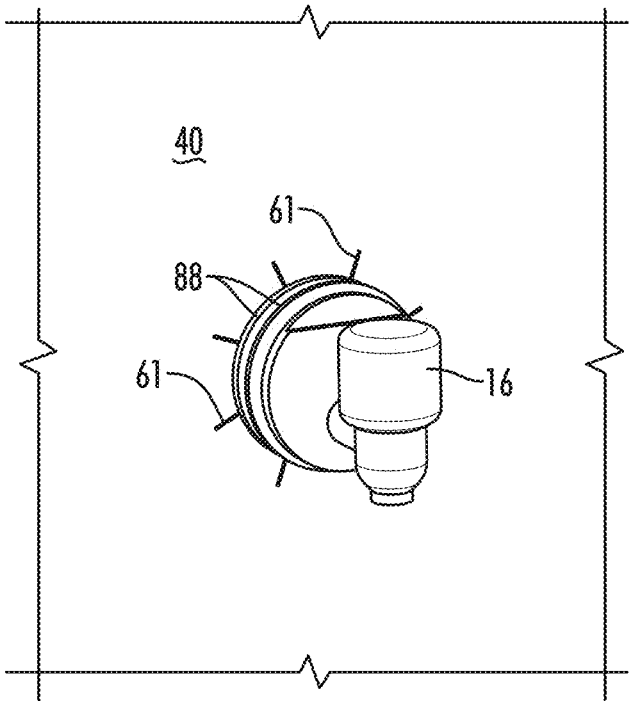
FIG. 34 is an isolation view of the tap secured in the front panel opening.
Figure 35:
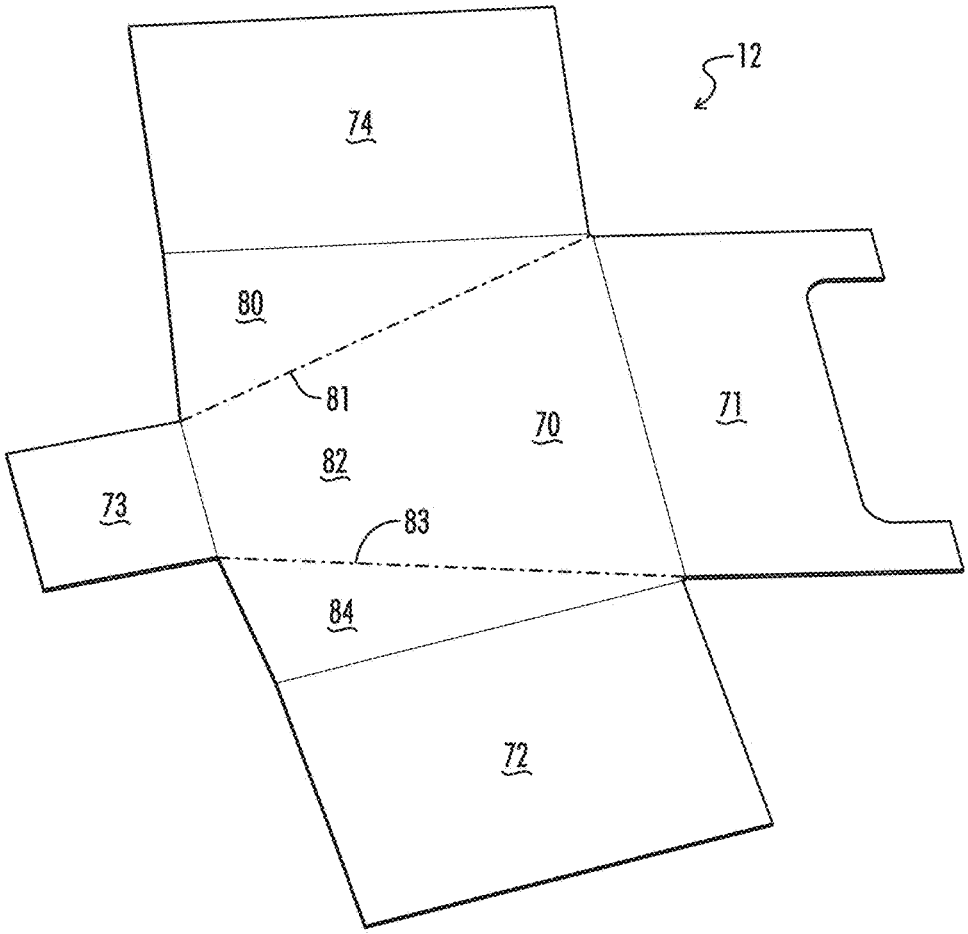
FIG. 35 is a top plan view of the insert.
Figure 36:
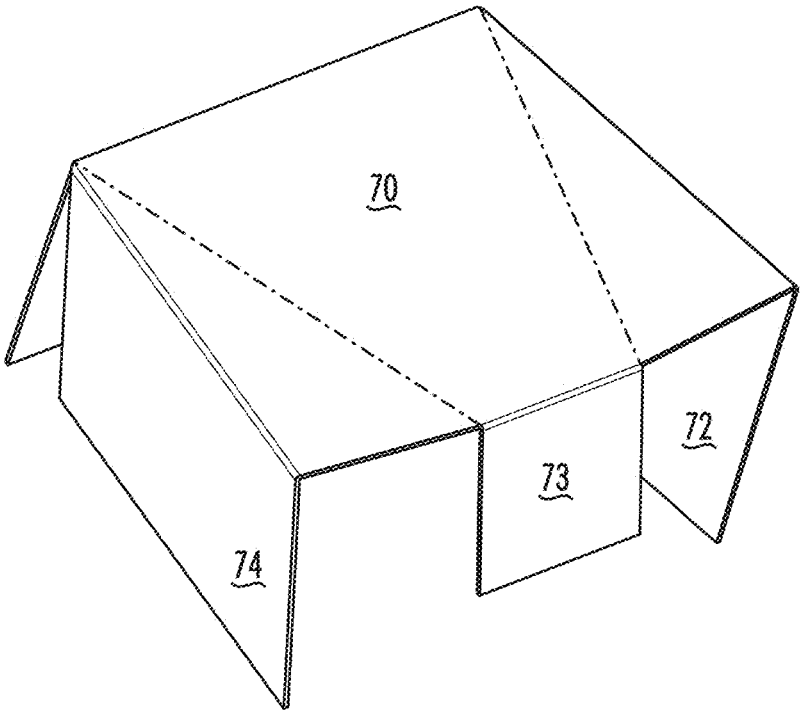
FIG. 36 is a front perspective view of the insert with folded edge panels.
Figure 37:
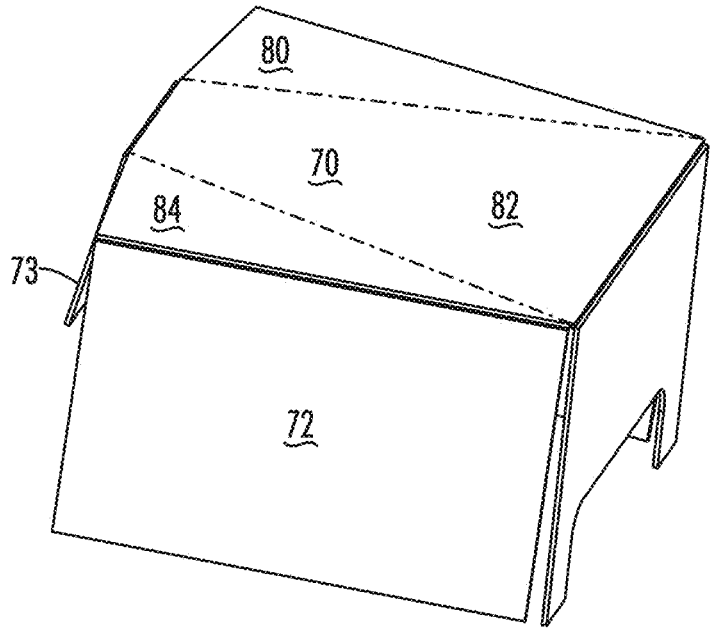
FIG. 37 is a right rear perspective view of the insert with edge panels folded.
Figure 38:
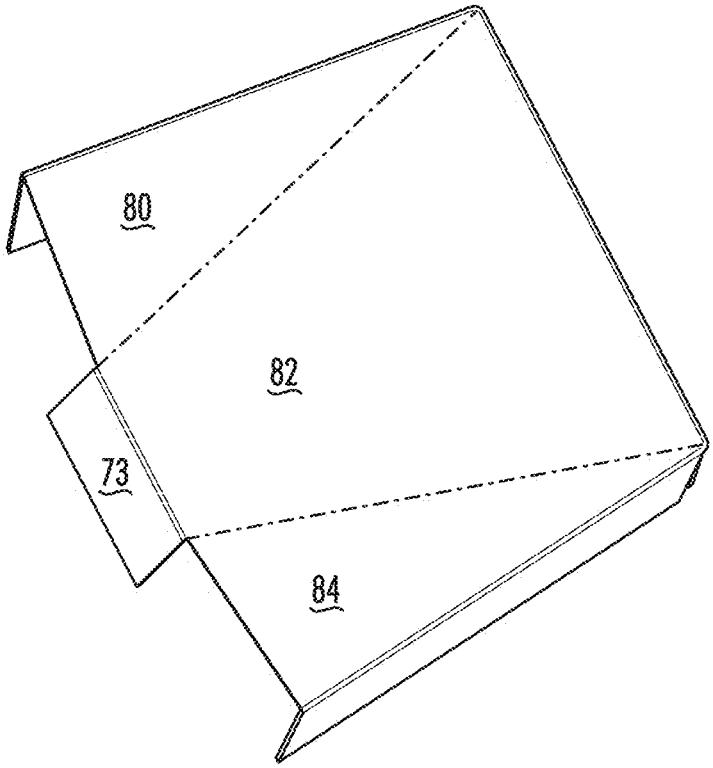
FIG. 38 is a top perspective view of the insert with edge panels folded.
Figure 39:
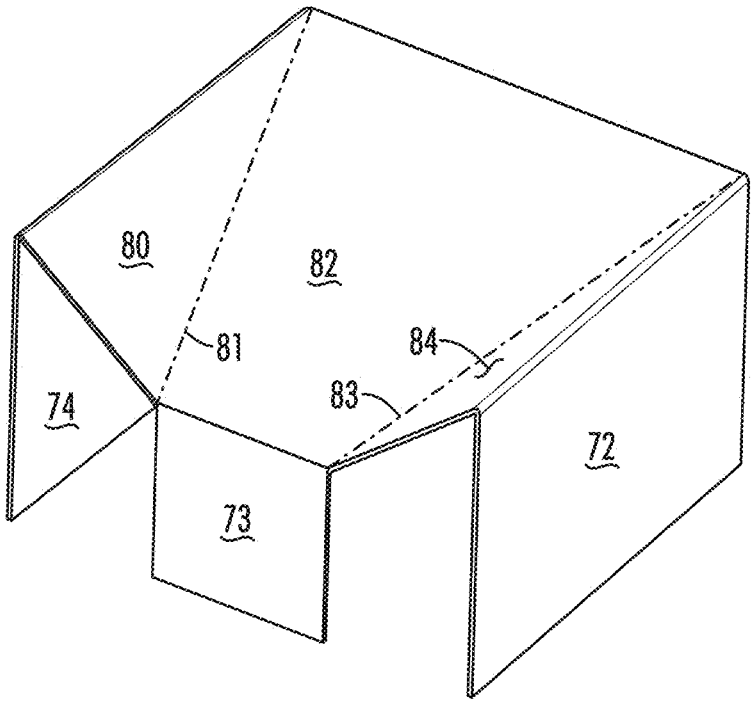
FIG. 39 is a front perspective view of the insert with edge and center panels folded.
Figure 40:
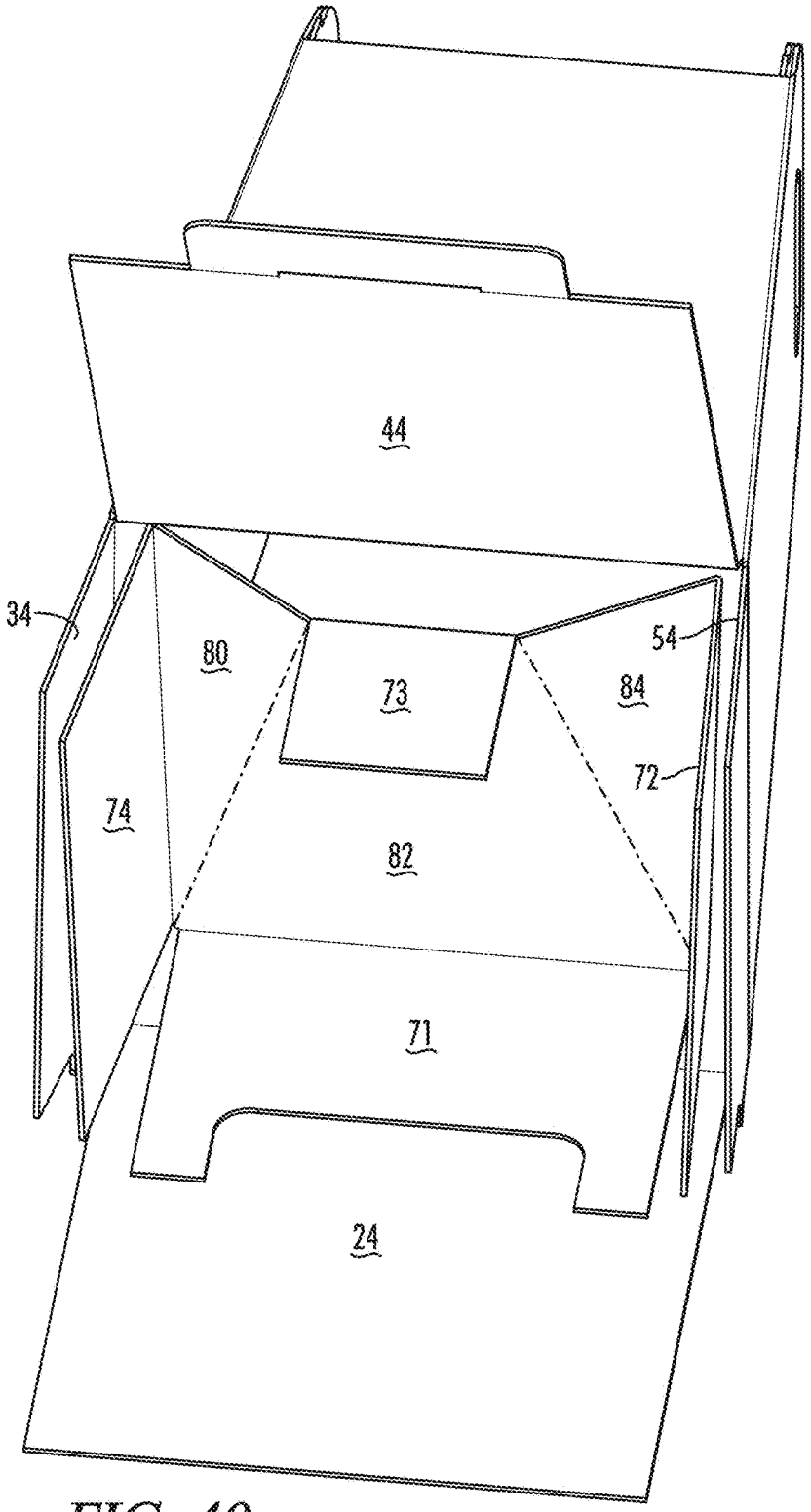
FIG. 40 is a bottom perspective view of the insert placed into the bottom of the outer shell.
Figure 41:
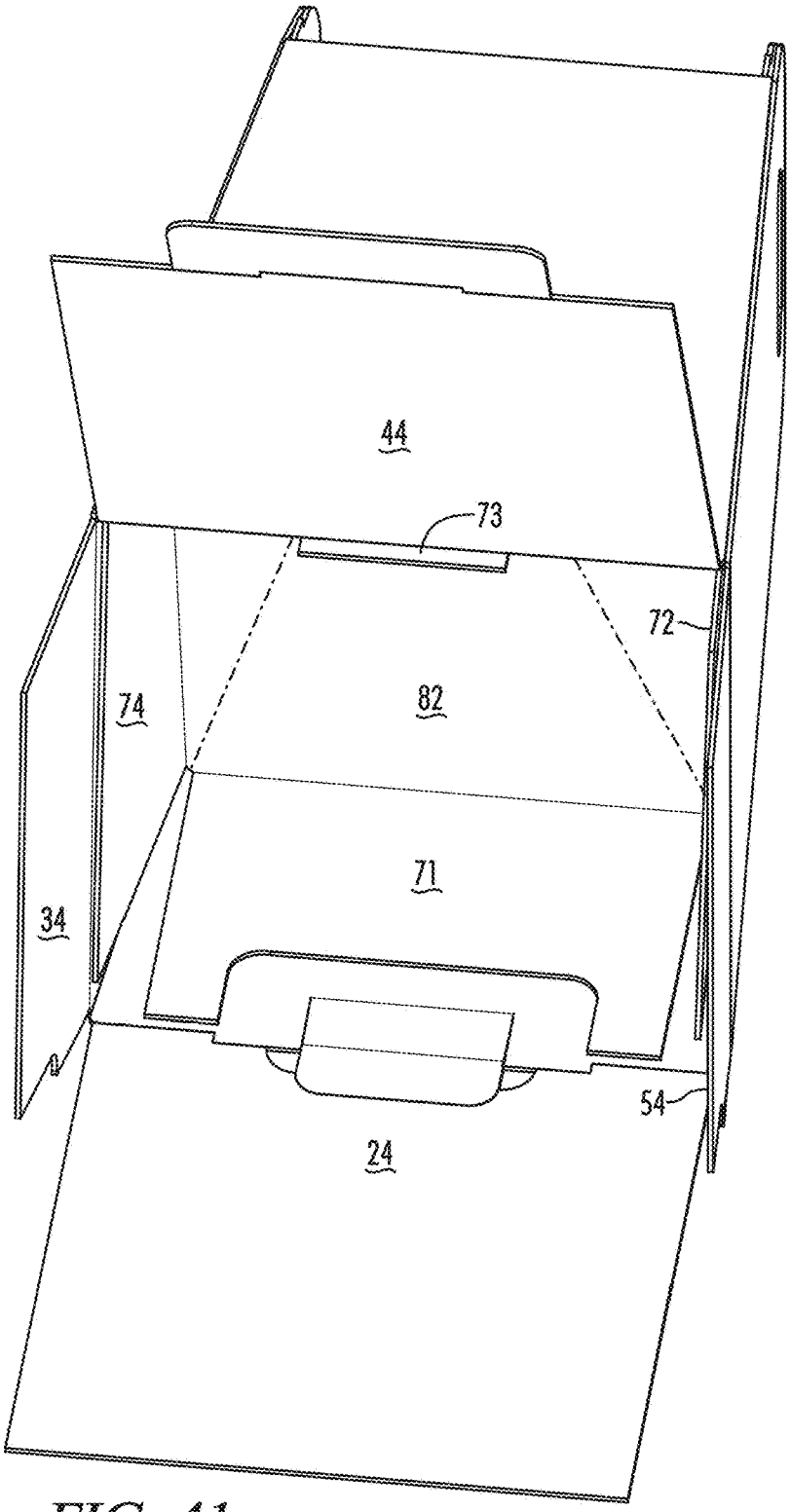
FIG. 41 is a bottom perspective view of the insert fully positioned within the outer shell.
Figure 42:
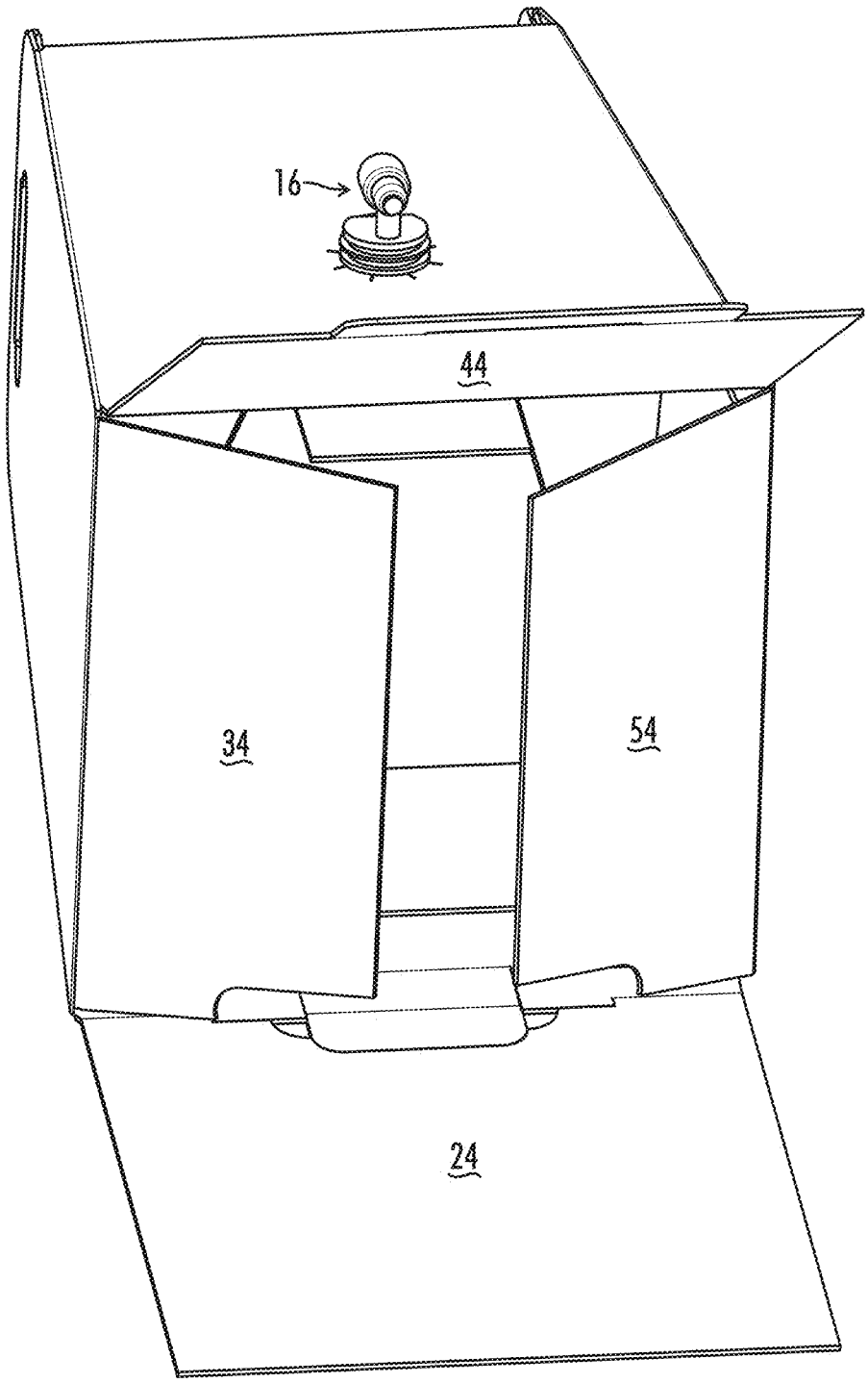
FIG. 42 is a bottom perspective view of the side bottom panels enclosing the insert within the bottom of the outer shell.
Figure 43:
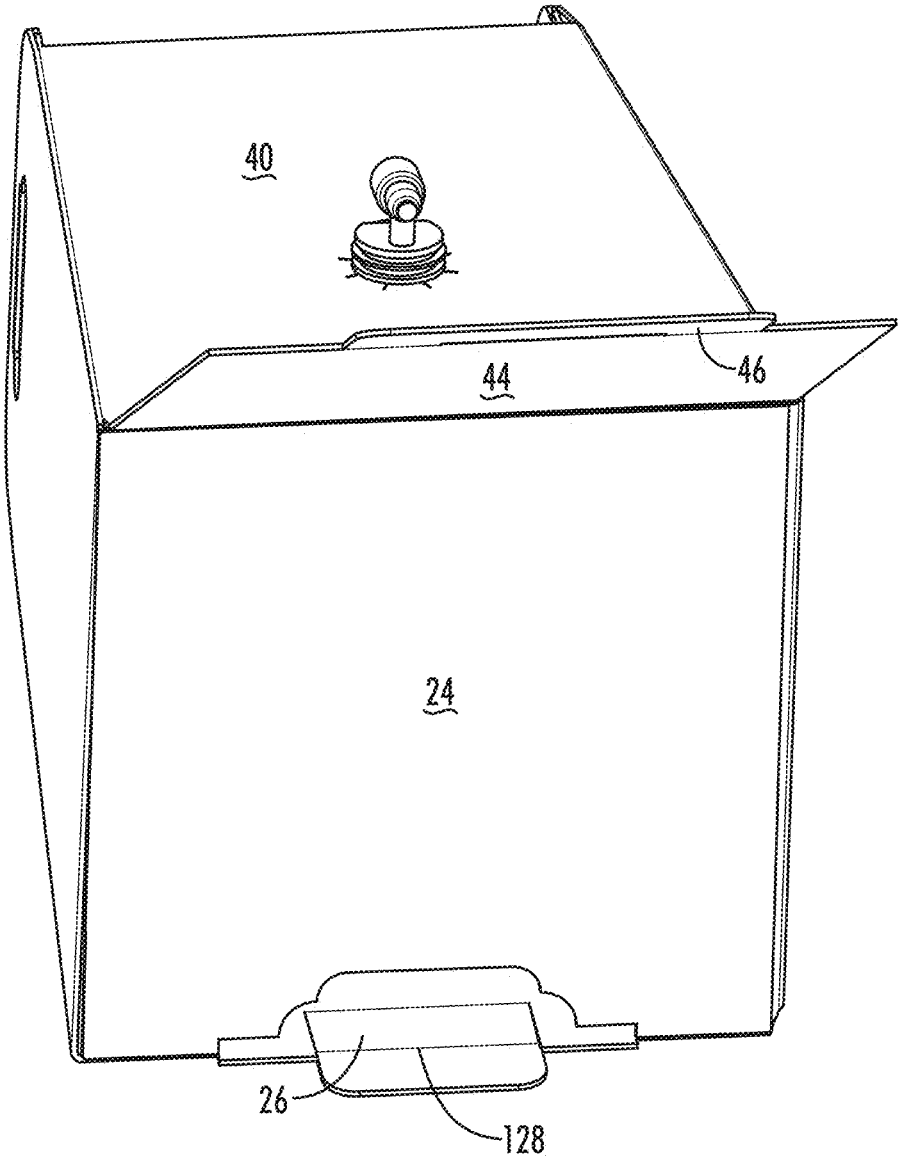
FIG. 43 is a bottom perspective view of the rear bottom panel folding over the side bottom panels of the outer shell.
Figure 44:
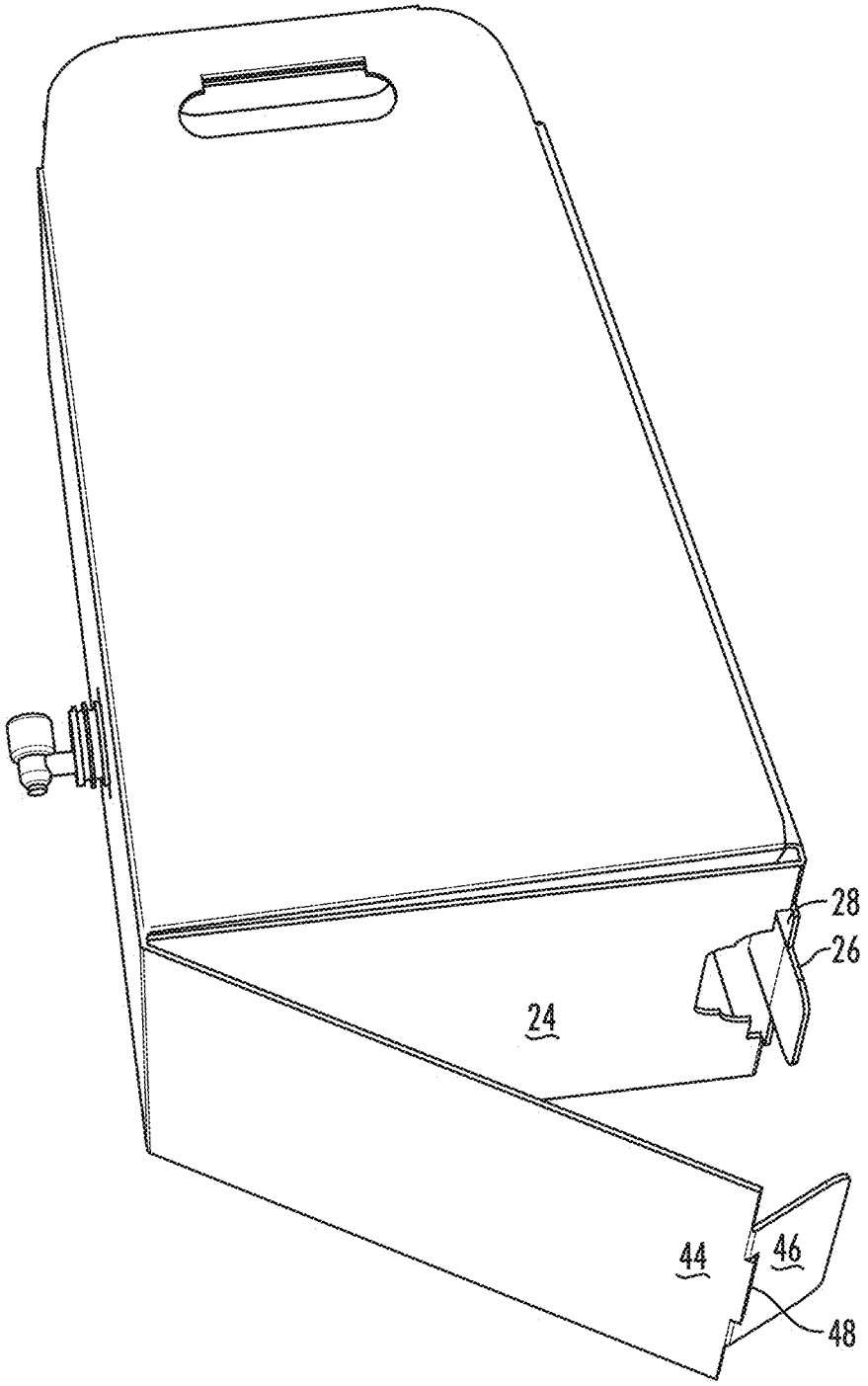
FIG. 44 is a bottom perspective view of the front bottom panel and the bottom latch.
Figure 45:
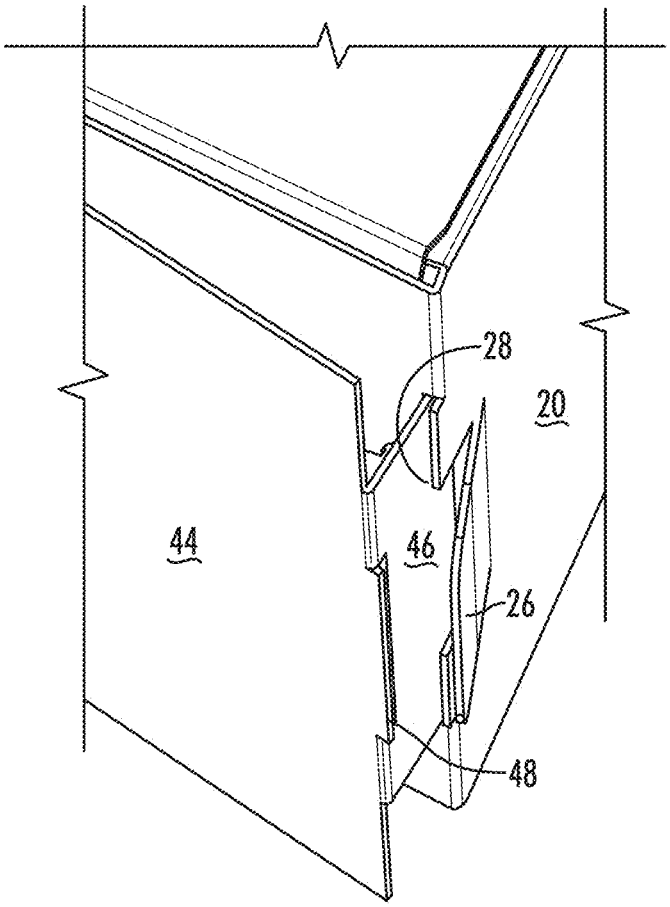
FIG. 45 is a bottom perspective view of the front bottom panel partially closed over the rear bottom panel with tab engaging the rear bottom panel slit.
Figure 46:
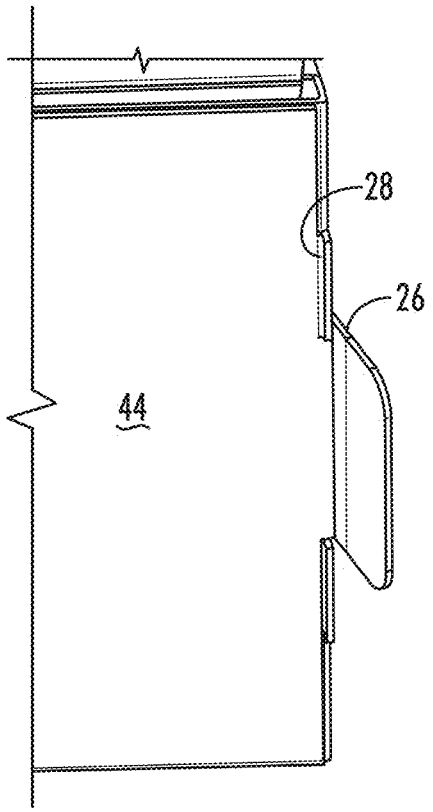
FIG. 46 is an illustration of the fully closed front bottom panel.
Figure 47:
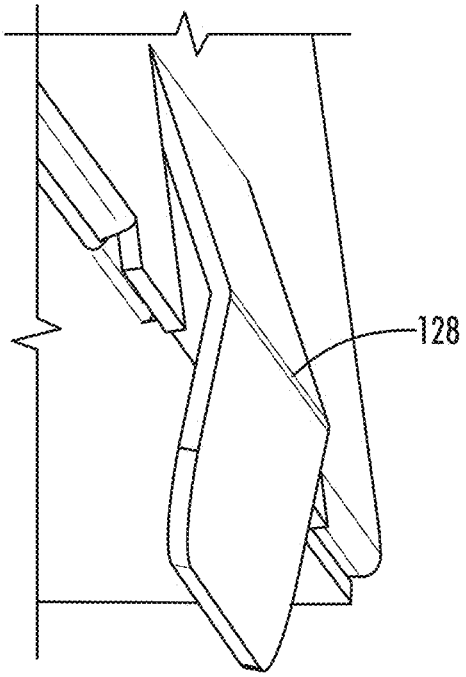
FIG. 47 is a bottom perspective view of the fully closed front bottom panel and bent rear panel tab.
Figure 48:
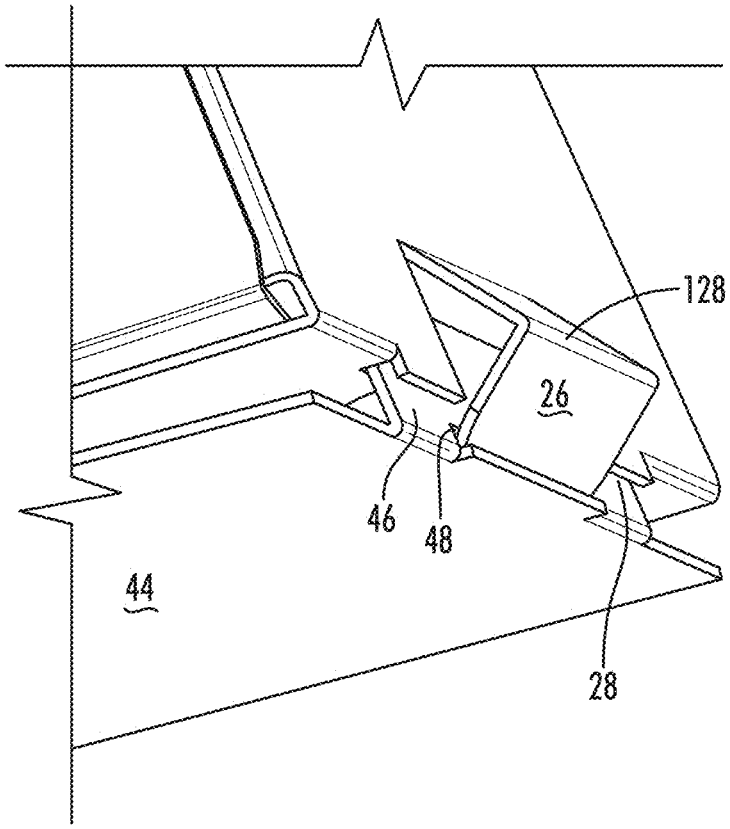
FIG. 48 is a bottom perspective view of the rear panel tab partially inserted in the front bottom panel slit.
Figure 49:
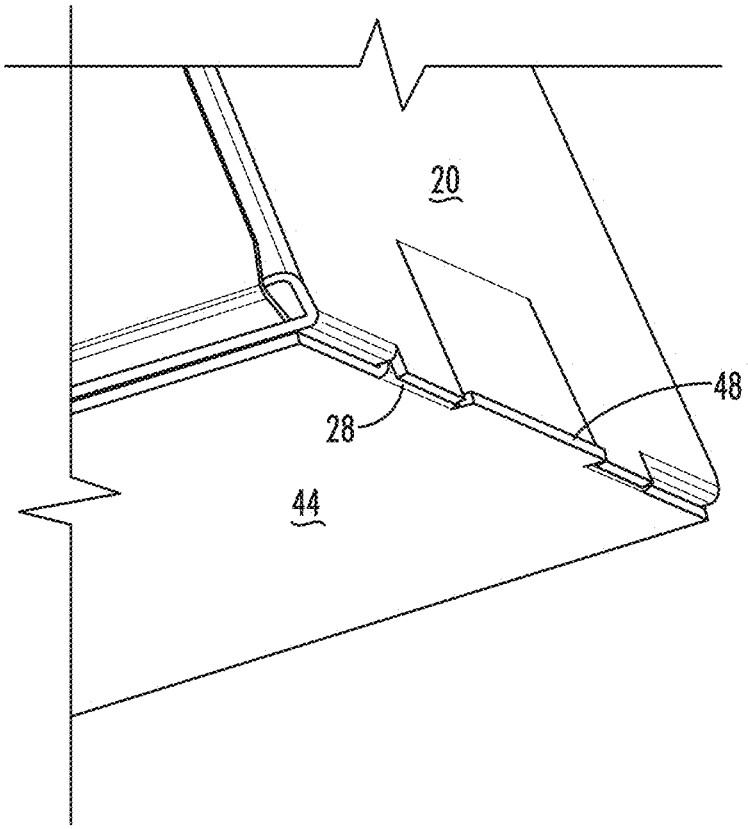
FIG. 49 is a bottom perspective view of the fully closed front bottom panel with rear panel tab fully inserted.

In addition, when bag 13 is filled by pouring liquid into opening 92 (shown in FIG. 32), the weight of the bag 13 is placed on insert 12. Weight on insert 12 is then transferred to the bottom edges of edge panels 71,72,73,74 and those edges are positioned adjacent on fold lines 22,32,42,52. By placing the weight at the fold lines at the periphery of the box formed by the outer shell 11, there is minimal leverage exerted upon the bottom panels 24,34,44,54. This enables the weight of the filled beverage bag 13 to be borne by the most structurally robust portion of the bottom of outer shell 11 and prevents the leveraged application of weight from being placed on the bottom panels 24, 34, 44, 54.

In effect, the insert 12 acts in a truss-like fashion and weight from the filled bag 13 is transferred to edge panels 71,72,73,74. The weight is applied to the edge panels in a longitudinally compressive fashion and the edge panels have no tendency to deform outward because of the constriction placed upon them by the panels 20,30,40,50 of the outer shell 11. Furthermore, the edge panels 71,72,73,74 have no tendency to deform in an inward fashion because of the pyramidal shape of the outer shell and insert 12. Because the edge panels are generally slightly angled outward in pyramidal fashion, there is minimal likelihood of an inward deformation. The tensile strength of the panels of the outer shell is sufficient for any reasonable weight carried in bag 13. Furthermore, the tensile strength of outer shell at the fold lines 22,32,42,52 is also quite substantial. As a result of focusing the weight carried by bag 13 in a fashion that acts largely to apply longitudinally compressive and longitudinally tensile directions, a corrugated board product is strong and the container has a robust structure.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

We claim:

1. A container blank of foldable material adapted to encase a container of liquid comprising:

(a) a rear trapezoidal shell panel having a fold line with a first central slit along an upper edge attached to a proximal edge of a rectangular rear top flap, and a top tab cut therein;

a fold line with a second central slit, along a lower edge that is relatively longer than the upper edge, attached to a proximal edge of a rear bottom flap, and a bottom tab cut therein;

a fold line along a left edge attached to an attachment panel;

a fold line along a right edge attached to a left side shell panel;

(b) said left side shell panel having a fold line along an upper edge attached to a proximal edge of a left top handle panel;

a fold line along a lower edge that is relatively longer than the upper edge, attached to a proximal edge of a left bottom flap;

a fold line along a right edge attached to a front shell panel;

(c) said front shell panel having a fold line along an upper edge attached to a proximal edge of a rectangular front top panel;

a fold line along a lower edge, attached to a proximal edge of a rectangular front bottom panel;

a fold line along a right edge attached to the right side shell panel;

(d) said right side shell panel having a fold line along an upper edge attached to a proximal edge of a right top handle panel;

a fold line along a lower edge that is relatively longer than the upper edge, attached to a proximal edge of a right bottom flap;

(e) said front bottom panel having a fold line with a third central slit along a distal edge attached to a front bottom tab; and (f) said front top panel having a fold line with a fourth central slit along a distal edge attached to a front top tab;

wherein the front shell panel has an opening to receive the tap of a beverage container.

2. The container blank of claim 1 wherein the rectangular front top panel has an opening therein to receive the fill cap of a beverage container.

3. The container blank of claim 1 wherein the foldable material is corrugated stock with channels of air contained therein.

4. The container blank of claim 1 in combination with a blank to form a ramped insert.

5. A container blank of foldable material adapted to encase a container of liquid comprising:

(a) a rear trapezoidal shell panel having a fold line with a first central slit along an upper edge attached to a proximal edge of a rectangular rear top flap, and a top tab cut therein;

a fold line with a second central slit, along a lower edge that is relatively longer than the upper edge, attached to a proximal edge of a rear bottom flap, and a bottom tab cut therein;

a fold line along a left edge attached to an attachment panel;

a fold line along a right edge attached to a left side shell panel;

(b) said left side shell panel having a fold line along an upper edge attached to a proximal edge of a left top handle panel;

a fold line along a lower edge that is relatively longer than the upper edge, attached to a proximal edge of a left bottom flap;

a fold line along a right edge attached to a front shell panel;

(c) said front shell panel having a fold line along an upper edge attached to a proximal edge of a rectangular front top panel;

a fold line along a lower edge, attached to a proximal edge of a rectangular front bottom panel;

a fold line along a right edge attached to the right side shell panel;

(d) said right side shell panel having a fold line along an upper edge attached to a proximal edge of a right top handle panel;

a fold line along a lower edge that is relatively longer than the upper edge, attached to a proximal edge of a right bottom flap;

(e) said front bottom panel having a fold line with a third central slit along a distal edge attached to a front bottom tab; and (f) said front top panel having a fold line with a fourth central slit along a distal edge attached to a front top tab;

in combination with a blank to form a ramped insert.

6. The container blank of claim 5 wherein the rectangular front top panel has an opening therein to receive the fill cap of a beverage container.

7. The container blank of claim 5 wherein the foldable material is corrugated stock with channels of air contained therein.

8. The container blank of claim 5 wherein the front shell panel has an opening to receive the tap of a beverage container.

9. A combination of a container blank and insert of foldable material wherein the container blank comprises:

four trapezoidal shell panels and an attachment panel;

at least two rectangular top panels connected along proximal edges to top fold lines of non-adjacent shell panels and having central slits along distal edges attached to tabs;

at least two bottom panels connected along proximal edges to bottom fold lines of non-adjacent shell panels and having central slits along distal edges attached to tabs;

and the insert comprises a trapezoidal center panel with two side edge fold lines attached to left and right edge panels, a rear edge fold line attached to a rear edge panel, and a front edge relatively longer than the rear edge having a centrally disposed front fold line attached to a centrally disposed front edge panel, and fold lines extending from the rear corners of the trapezoidal center panel to the sides of the fold line attached to the front edge panel, and wherein the height of the rear edge panel is greater than the height of the front edge panel.

10. The container blank of claim 9 wherein the rectangular top panels have openings therein to receive the fill cap of a beverage container.

11. The container blank of claim 9 wherein the foldable material is corrugated stock with channels of air contained therein.

12. The container blank of claim 9 wherein a trapezoidal shell panel has an opening to receive the tap of a beverage container.

* * * * *